US011199344B2

(12) United States Patent
Miyawaki et al.

(10) Patent No.: US 11,199,344 B2
(45) Date of Patent: Dec. 14, 2021

(54) HEAT EXCHANGER AND AIR-CONDITIONING APPARATUS

(71) Applicant: Mitsubishi Electric Corporation, Chiyoda-ku (JP)

(72) Inventors: Kosuke Miyawaki, Chiyoda-ku (JP); Takahiro Hori, Chiyoda-ku (JP); Norihiro Yoneda, Chiyoda-ku (JP); Susumu Yoshimura, Chiyoda-ku (JP); Yoji Onaka, Chiyoda-ku (JP); Takashi Matsumoto, Chiyoda-ku (JP); Ryota Akaiwa, Chiyoda-ku (JP); Yasuhiro Yoshida, Chiyoda-ku (JP); Kazuhiro Miya, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 579 days.

(21) Appl. No.: 15/737,403

(22) PCT Filed: Mar. 11, 2016

(86) PCT No.: PCT/JP2016/057811
§ 371 (c)(1),
(2) Date: Dec. 18, 2017

(87) PCT Pub. No.: WO2017/010120
PCT Pub. Date: Jan. 19, 2017

(65) Prior Publication Data

US 2018/0164005 A1 Jun. 14, 2018

(30) Foreign Application Priority Data

Jul. 10, 2015 (JP) ..... JP2015-139026

(51) Int. Cl.
*F25B 39/00* (2006.01)
*F28F 19/04* (2006.01)
(Continued)

(52) U.S. Cl.
CPC ..... *F25B 39/00* (2013.01); *F28D 1/047* (2013.01); *F28F 1/28* (2013.01); *F28F 1/32* (2013.01);
(Continued)

(58) Field of Classification Search
CPC .. F25B 39/00; F28D 1/047; F28D 1/04; F28F 1/28; F28F 1/32; F28F 3/086; F28F 9/02;
(Continued)

(56) References Cited

U.S. PATENT DOCUMENTS 2,788,195 A * 4/1957 Karmazin ..... B21D 53/04 165/76
3,068,905 A * 12/1962 Millington ..... F28F 1/28 138/38
(Continued)

FOREIGN PATENT DOCUMENTS

DE 102009021291 A1 * 11/2010 ..... B23K 1/012
GB 1448294 9/1976
(Continued)

OTHER PUBLICATIONS

Machine Translation JP2010-169344A (Year: 2010).*
(Continued)

*Primary Examiner* — Len Tran
*Assistant Examiner* — Gustavo A Hincapie Serna
(74) *Attorney, Agent, or Firm* — Xsensus LLP

(57) ABSTRACT

A heat exchanger and an air-conditioning apparatus that exhibit high performance, and also provide reliability in strength and corrosion resistance. The heat exchanger includes a plurality of fins each including a fin collar formed in a short cylindrical shape by perforating a flat base plate, the plurality of fins being stacked by serially connecting fin collars of the respective fins, the serially connected fin collars being bonded to form a conduit line and a fin core,
(Continued)

the conduit line including a resin layer formed on an inner surface thereof. The heat exchanger also includes a reinforcing member having a length corresponding to a length of the conduit line from one end to the other end thereof, to improve rigidity of the conduit line.

17 Claims, 15 Drawing Sheets

(51) Int. Cl.

| | |
|---|---|
| ***F28F 1/32*** | (2006.01) |
| ***F28F 3/08*** | (2006.01) |
| ***F28F 9/02*** | (2006.01) |
| ***F28F 1/28*** | (2006.01) |
| ***F28D 1/047*** | (2006.01) |

(52) U.S. Cl.
CPC ..... *F28F 3/086* (2013.01); *F28F 9/02* (2013.01); *F28F 19/04* (2013.01); *F28F 2275/205* (2013.01)

(58) Field of Classification Search
CPC ..... F28F 19/04; F28F 2275/205; F28F 19/06; F28F 9/16; F28F 2225/00; F28F 2225/04; F28F 9/007; F28F 9/0075; F28F 2240/00
USPC ..... 62/498; 165/151, 152, 181, 182, 906
See application file for complete search history.

(56) References Cited

U.S. PATENT DOCUMENTS

| | | | | | |
|---|---|---|---|---|---|
| 3,515,207 | A * | 6/1970 | Lu | F28F 1/32 | 165/151 |
| 3,993,126 | A * | 11/1976 | Taylor | F28F 9/162 | 165/173 |
| 4,193,180 | A * | 3/1980 | Press | B05D 7/22 | 156/244.13 |
| 4,342,150 | A * | 8/1982 | Mack | B21C 37/22 | 29/726 |
| 4,479,363 | A * | 10/1984 | Gibson | A23C 13/085 | 62/340 |
| 4,799,540 | A * | 1/1989 | Pietzcker | F28F 1/32 | 165/76 |
| 5,158,134 | A * | 10/1992 | Mongia | F28D 1/0477 | 165/149 |
| 5,178,211 | A * | 1/1993 | Bauer | F25B 39/04 | 165/153 |
| 5,318,112 | A * | 6/1994 | Gopin | F28D 1/05366 | 165/151 |
| 5,551,507 | A * | 9/1996 | Vogel | F28B 1/06 | 165/149 |
| 5,604,982 | A * | 2/1997 | Kent | B21C 37/151 | 29/727 |
| 2010/0270013 | A1* | 10/2010 | Lee | F28D 1/0477 | 165/182 |
| 2012/0160465 | A1* | 6/2012 | Webb | F28F 13/06 | 165/173 |
| 2015/0068714 | A1* | 3/2015 | Garosshen | F28F 19/06 | 165/134.1 |
| 2016/0047606 | A1* | 2/2016 | Wada | F28F 1/10 | 62/498 |
| 2017/0123681 | A1* | 5/2017 | Khandelwal | G06F 3/064 | |
| 2017/0248370 | A1* | 8/2017 | Nakamura | B21D 53/08 | |

FOREIGN PATENT DOCUMENTS

| | | | | | |
|---|---|---|---|---|---|
| JP | 61-15359 | B2 | | 9/1979 | |
| JP | 59-229194 | A | | 12/1984 | |
| JP | 63-159668 | U | | 10/1988 | |
| JP | 2000051980 | A | * | 2/2000 | F28F 1/32 |
| JP | 2009-236374 | A | | 10/2009 | |
| JP | 2010-169344 | A | | 8/2010 | |
| JP | 2010169344 | A | * | 8/2010 | |
| JP | 2014-95503 | A | | 5/2014 | |
| WO | 2007/049438 | A1 | | 5/2007 | |
| WO | WO-2008099434 | A1 | * | 8/2008 | F28D 7/0066 |

OTHER PUBLICATIONS

International Search Report dated Jun. 7, 2016 in PCT/JP2016/057811 filed Mar. 11, 2016.
Office Action dated Nov. 6, 2018 in Japanese Patent Application No. 2017-528295, 13 pages (with unedited computer generated English translation).

* cited by examiner

HEAT EXCHANGER AND AIR-CONDITIONING APPARATUS

TECHNICAL FIELD

The present invention relates to a plate-fin heat exchanger for use in an air-conditioning apparatus such as a room air-conditioner or a package air-conditioner, and more particularly to a heat exchanger and an air-conditioning apparatus, configured to improve strength of joint portions between a plurality of fins, the fins being serially connected to each other by superposing fin collars of each of the fins.

BACKGROUND ART

Conventional heat exchangers include a plurality of fins, each having a plurality of fin collars, each formed in a short cylindrical shape by perforating a flat base plate. The plurality of fins are stacked on each other, with the fin collars of the fin serially connected to the corresponding fin collars of the adjacent fin. Further, the fin collars adjacent to each other are bonded with a resin to form conduit lines and a fin core, and a resin layer is formed on the inner surface of each of the conduit lines.

The heat exchanger configured as above allows a fluid passing through the fin core to exchange heat with a fluid passing through the conduit line. In addition, since the inner surface of the conduit line is coated with the resin, the conduit line is sealed, and corrosion of the metal surface of the conduit line can be prevented (see, for example, Patent Literature 1).

CITATION LIST

Patent Literature

Patent Literature 1: Japanese Examined Patent Application Publication No. 61-015359

SUMMARY OF INVENTION

Technical Problem

In the conventional heat exchanger, the joint portions between the serially connected fin collars are only fixed with the resin. Therefore, sufficient strength is unable to be secured against a bending, twisting, or shearing force, applied to the joint portion when the heat exchanger is installed in a casing, or transported.

To improve the strength of the joint portion, the thickness of the resin layer may be increased. However, increasing the thickness of the resin layer leads to increased thermal resistance, and hence to degraded heat exchange performance.

The present invention has been accomplished in view of the foregoing problem, and provides a heat exchanger that exhibits high performance, and also provides reliability in strength and corrosion resistance, and an air-conditioning apparatus including such a heat exchanger.

Solution to Problem

In one embodiment, the present invention provides a heat exchanger including A heat exchanger including a plurality of fins each including a fin collar formed in a short cylindrical shape by perforating a flat base plate, the plurality of fins being stacked by serially connecting fin collars of the respective fins, the serially connected fin collars being bonded to form a conduit line and a fin core, the conduit line including a resin layer formed on an inner surface thereof, the heat exchanger comprising a reinforcing member having a length corresponding to a length of the conduit line from one end to an other end thereof, to improve rigidity of the conduit line.

Advantageous Effects of Invention

Since the heat exchanger of one embodiment of the present invention includes the reinforcing member having a length corresponding to the length of the conduit line from one end to the other end thereof, to improve rigidity of the conduit line, the strength of the joint portion against a bending, twisting, or shearing force, applied when the heat exchanger is installed in a casing or transported, can be improved. In addition, there is no need to increase the thickness of the resin layer to improve the strength, and therefore degradation in heat exchange performance originating from the increased thermal resistance of the resin layer can be prevented. Consequently, a high performance level, and reliability in strength and corrosion resistance, can both be secured.

DESCRIPTION OF EMBODIMENTS

Figure 1:
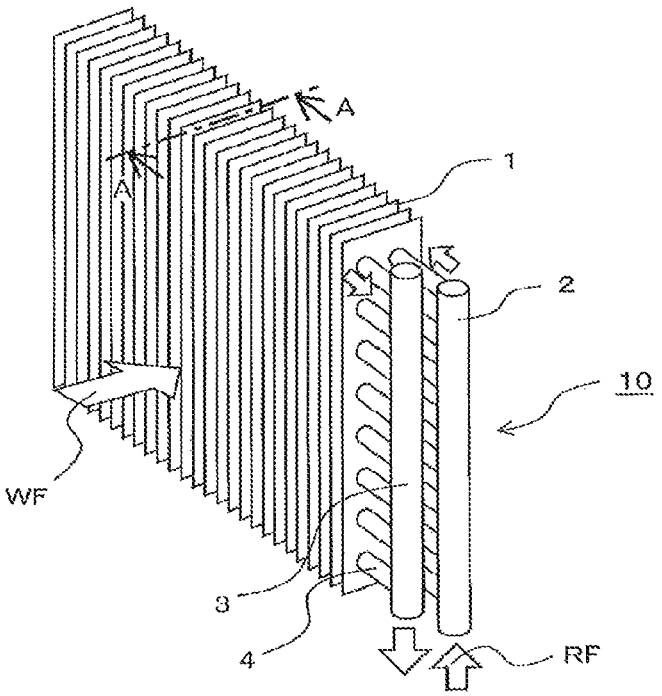
FIG. 1 is a perspective view showing a heat exchanger according to Embodiment 1 of the present invention.

Hereinafter, Embodiments of a heat exchanger according to the present invention will be described.

The shapes of elements expressed in the drawings are merely exemplary, and not intended to limit the present invention. In all the drawings, the elements of the same reference sign represent the same or corresponding ones, which applies throughout the description. Further, in all the drawings, the dimensional relationship among the elements may differ from the actual ones.

Embodiment 1

Figure 2:
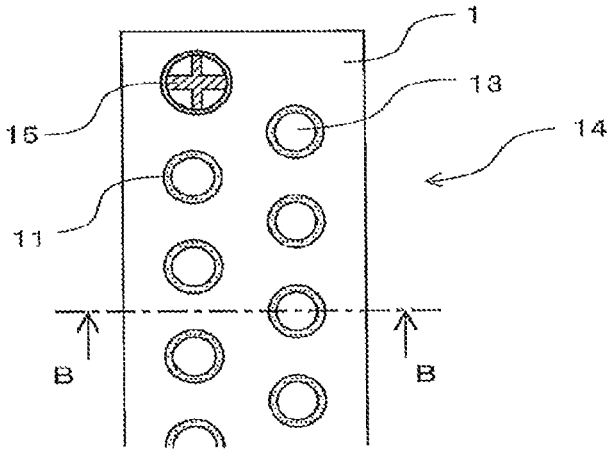
FIG. 2 is a cross-sectional view taken along a line A-A in FIG. 1, showing a fin core of the heat exchanger according to Embodiment 1 of the present invention.
Figure 3:
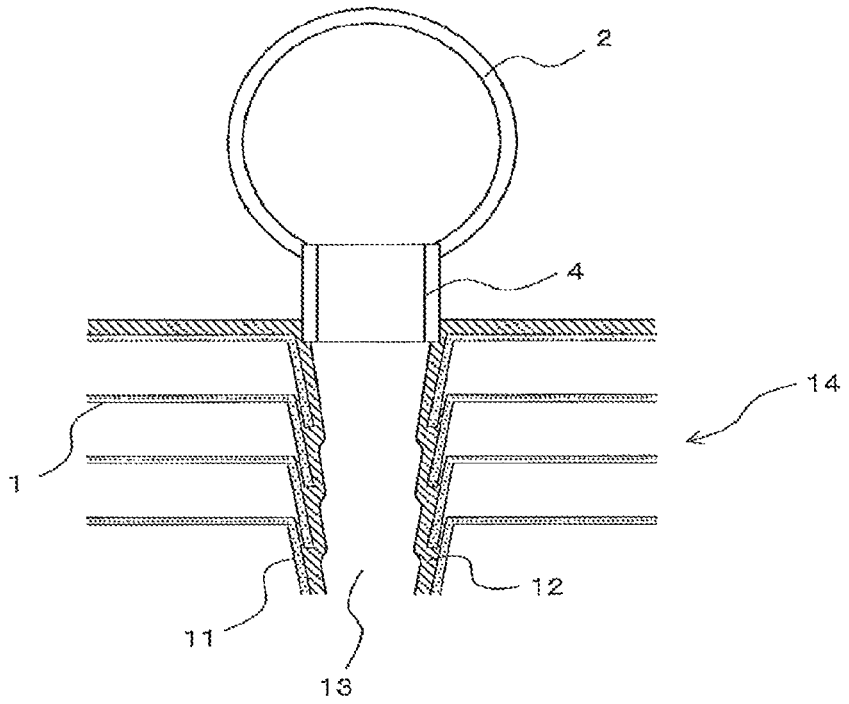
FIG. 3 is a cross-sectional view taken along a line B-B in FIG. 2, showing a conduit line of the heat exchanger according to Embodiment 1 of the present invention.
Figure 4:
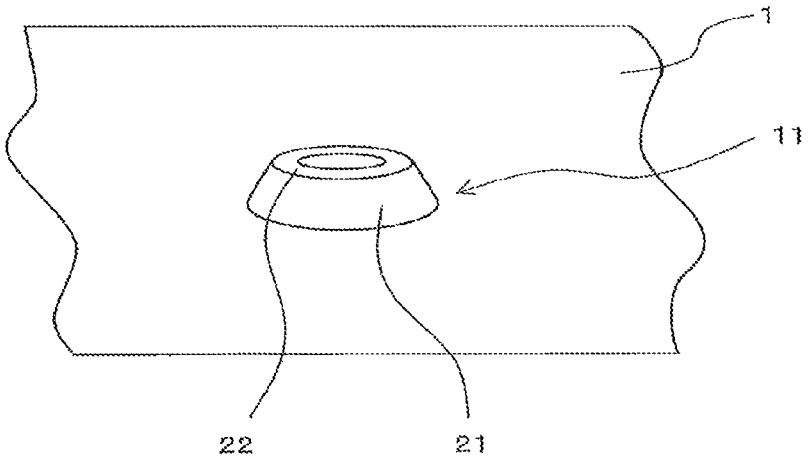
FIG. 4 is an enlarged perspective view showing a fin collar of the heat exchanger according to Embodiment 1 of the present invention.
Figure 5:
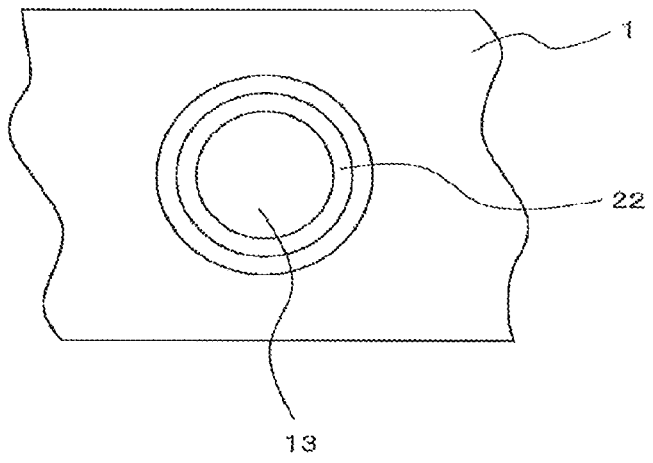
FIG. 5 is a plan view showing the fin collar of the heat exchanger according to Embodiment 1 of the present invention.
Figure 6:
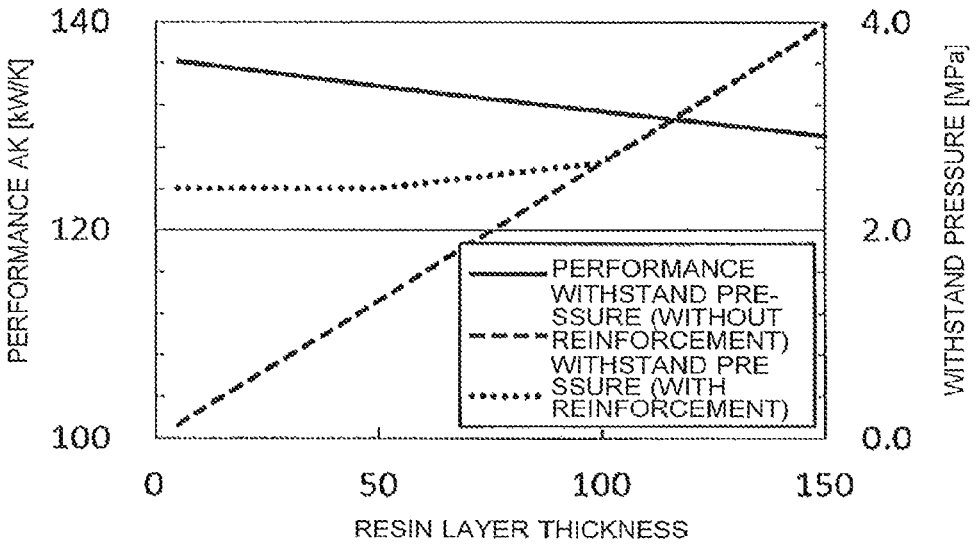
FIG. 6 is a schematic diagram showing a relationship between a thickness of a resin layer in the conduit line, and performance and mechanical strength of the heat exchanger according to Embodiment 1 of the present invention.

FIG. 1 is a perspective view showing a heat exchanger 10 according to Embodiment 1 of the present invention. FIG. 2 is a cross-sectional view taken along a line A-A in FIG. 1, showing a fin core 14 of the heat exchanger 10 according to Embodiment 1 of the present invention. FIG. 3 is a cross-sectional view taken along a line B-B in FIG. 2, showing a conduit line 13 of the heat exchanger 10 according to Embodiment 1 of the present invention. FIG. 4 is an enlarged perspective view showing a fin collar 11 of the heat exchanger 10 according to Embodiment 1 of the present invention. FIG. 5 is a top plan view showing the fin collar 11 of the heat exchanger 10 according to Embodiment 1 of the present invention. FIG. 6 is a schematic diagram showing a relationship between a thickness of a resin layer in the conduit line 13, and performance and mechanical strength of the heat exchanger 10 according to Embodiment 1 of the present invention.

In the drawings, a blank arrow denoted by WF indicates an airflow direction, and a blank arrow denoted by RF indicates a refrigerant flow direction.

As shown in FIG. 1 to FIG. 6, the heat exchanger 10 according to Embodiment 1 includes a plurality of fins 1, each including a plurality of fin collars 11 formed in a short cylindrical shape by perforating a flat base plate.

The fins 1 are serially connected to each other, by superposing the fin collars 11 on the corresponding ones of the adjacent fin 1. The serially connected fin collars 11 are bonded to the adjacent ones with a resin to form a plurality of conduit lines 13 and the fin core 14 along which air flows, and a resin layer 12 is formed to cover the inner surface of the conduit line 13.

Although the conduit lines 13 formed as above have a cylindrical shape as shown in FIG. 2, the shape of the conduit lines 13 is not specifically limited, and not limited to a symmetrical shape.

The conduit lines 13 each include a joint pipe 4 connected to the respective end portions, at the terminal one of the fins 1 stacked on each other. The conduit lines 13 are aligned in a plurality of rows, for example in two rows as shown in FIG. 1, in a direction orthogonal to the stacking direction of the fins 1, in other words in the airflow direction (WF), or row direction, and aligned in a plurality of columns, for example in eight columns as shown in FIG. 1, in a direction orthogonal to the row direction, in other words in the column direction.

Out of the plurality of conduit lines 13 aligned in the row direction, the plurality of conduit lines 13 located on the leeward side are each connected to an inlet header 2, at an end portion. The plurality of conduit line 13 located on the windward side are each connected to an outlet header 3, at an end portion. The leeward section and the windward section of each of the plurality of conduit lines 13 are communicably connected to each other at the non-illustrated other end portion, for example via a U-pipe.

Some of the plurality of conduit lines 13 include a resin structure 15, exemplifying the reinforcing member, inserted in the conduit line 13 and fastened to the end portions of the fin core 14 with a resin material.

The resin structure 15 has a cross section in a cross shape formed to contact the inner wall of the conduit line 13 at every 90 degrees, and extends throughout the conduit line 13 from one end to the other. Thus, the resin structure 15 has a length corresponding to the length of the conduit line 13 from one end to the other, and serves to improve the rigidity of the conduit line 13.

The resin structure 15 exemplifying the reinforcing member corresponds to the resin structural material provided inside the conduit line 13.

As shown in FIG. 3, the fin collar 11 is formed in a tapered shape, such that distal end portion in the stacking direction is smaller in diameter than the base portion.

As shown in FIG. 4 and FIG. 5, the fin collar 11 includes a cylindrical portion 21 and a top portion 22. The fin collars 11 are serially connected to each other, with the top portion 22 inserted into the cylindrical portion 21 of the adjacent fin collar 11. Serially connecting thus the fin collars 11 constitutes the stacked structure of the fins 1.

An operation of the heat exchanger 10 according to Embodiment 1 will be described hereunder, referring to the case where the heat exchanger 10 is incorporated in an indoor unit of an air-conditioning apparatus in which the heat exchange is performed between refrigerant and air.

As indicated by the airflow direction (WF) in FIG. 1, the air is introduced into the heat exchanger 10, for example by a fan, flows along the fin core 14, more specifically through the gap defined between the fins 1 adjacent to each other, and flows out from the heat exchanger 10 after exchanging heat with the refrigerant, such as water, flowing in the conduit line 13.

The refrigerant flows as follows. In a heating operation, the refrigerant flowing in the conduit lines 13 of the heat exchanger 10, assuming the form of hot water, heats the air. The hot water flows into the heat exchanger 10 from the inlet header 2, flows through the leeward section of the conduit line 13 in the stacking direction of the fins 1, passes through the U-pipe and flows through the windward section of the conduit line 13, and flows out from the heat exchanger 10 after being merged in the outlet header 3. The hot water is subjected to the heat exchange in what is known as a pseudo-counterflow method.

In a cooling operation, the refrigerant flows in the same way as in the heating operation, except that the refrigerant flowing in the conduit lines 13 of the heat exchanger 10, assuming the form of cold water, cools the air.

Referring to FIG. 2 and FIG. 3, a manufacturing method of the heat exchanger 10 according to Embodiment 1 will be described hereunder.

The fins 1, each including a plurality of fin collars 11 formed in a tapered cylindrical shape, for example by pressing, are serially connected by superposing the fin collars 11 as shown in FIG. 3.

A resin is injected into inside of the cylindrical portions 21 of the respective fins 1, from the terminal one of the fins 1 connected as above, and then the inlet header 2, the outlet header 3, and the joint pipes 4 are attached.

To form the resin layer 12 inside the fin collars 11, precoated fins to which a resin is applied in advance may be employed. Then, the resin is heated and fluidized to cover the surface of the inner wall of the conduit line 13, formed of the fin collars 11, with the resin. The resin is also led to permeate into the joint portions between the fin collars 11 adjacent to each other, to bond the fin collars 11 together, and then cooled and solidified to fix the fin collars 11.

In this process, the type of the resin, as well as the temperature and the time for heating and cooling are properly selected, and the resin layer 12 is formed over the surface of the inner wall of the conduit line 13 in a thin thickness, preferably equal to or less than 50 μm.

Then, the resin structure 15 shown in FIG. 2, serving as the reinforcing member, is inserted in each of the conduit lines 13 of predetermined positions. Since the resin structure 15 inserted in the conduit line 13 has a length corresponding to the length of the conduit line 13 from one end to the other, the resin structure 15 can be easily fastened to the end portions of the fin core 14 with a resin material, and thus the manufacturing process can be simplified. Providing the resin structure 15 in as many number of conduit lines 13 as possible leads to improved strength of the heat exchanger 10. However, it is preferable, from the viewpoint of cost, to provide the resin structure 15 in a minimum possible number of conduit lines 13.

Although the resin structure 15 has a cross section in a cross shape as shown in FIG. 2, the shape of the resin structure 15 is not specifically limited, and not limited to a symmetrical shape. In addition, the material of the resin structure 15 serving as the reinforcing member is not limited to resins but may be a metal, provided that the metal has sufficient corrosion resistance.

However, it is preferable to employ a resin to form the reinforcing member, because the resin layer 12 is unlikely to be peeled off owing to friction with the reinforcing member.

The process of covering with the resin the surface of the inner wall of the conduit line 13, formed of the fin collars 11, and the process of inserting and fixing the resin structure 15 in the conduit line 13 may be performed in a reversed order, provided that the resin structure 15 is not affected by the heating temperature required for fluidizing the resin.

In particular, in the case where the reinforcing member is formed of a metal, the resin layer 12 may be peeled off owing to friction with the reinforcing member. Accordingly, it is preferable to form the resin layer 12 after inserting the reinforcing member. In the case where the resin layer 12 is formed after the reinforcing member is inserted, at least a portion of the surface of the reinforcing member, in particular a portion abutted to the inner wall of the conduit line 13, is covered with the resin layer 12, and hence the resin layer 12 can be prevented from being peeled off. In the case where the reinforcing member is formed of a resin also, forming the resin layer 12 after inserting the reinforcing member prevents the resin layer from being peeled off. Thus, at least a part of the reinforcing member may be covered with the same resin layer 12 covering the inner surface of the conduit line 13.

As described above, the heat exchanger 10 according to Embodiment 1 includes the resin structure 15, having the length corresponding to the length of the conduit line 13 from one end to the other and provided in some of the conduit lines 13, to improve the rigidity of the conduit line 13. Accordingly, the rigidity of the heat exchanger 10 is increased, and the strength of the joint portion between the serially connected fin collars 11, against a bending, twisting, or shearing force applied when the heat exchanger 10 is installed in the casing or transported, can be improved. In addition, there is no need to increase the thickness of the resin layer 12 in the conduit line 13 to increase the strength of the joint portion, and the resin layer 12 can be formed in a thin thickness on the surface of the inner wall of the conduit line 13 formed of the fin collars 11, which prevents degradation in heat exchange performance originating from an increase in thermal resistance of the resin layer 12. Consequently, a high performance level, and reliability in strength and corrosion resistance, can both be secured.

Here, the number of conduit lines 13 aligned in the row direction and the column direction may be determined as desired, without limitation to the example in Embodiment 1. In addition, the heat exchange between air and the refrigerant may be performed in a pseudo-parallel flow method by inverting the airflow direction, instead of in the pseudo-counterflow method. Further, the conduit line 13 including the resin structure 15 inserted therein may be, or may not be, utilized for the heat exchange by supplying the refrigerant. In other words, the resin structure 15 may be provided only in some of conduit lines 13 through which the refrigerant flows, out of the plurality of conduit lines 13.

Embodiment 2

In Embodiment 2, the conduit line 13 is filled with a resin that constitutes the reinforcing member. The items not specifically referred to in Embodiment 2 are the same as those of Embodiment 1.

Figure 7:
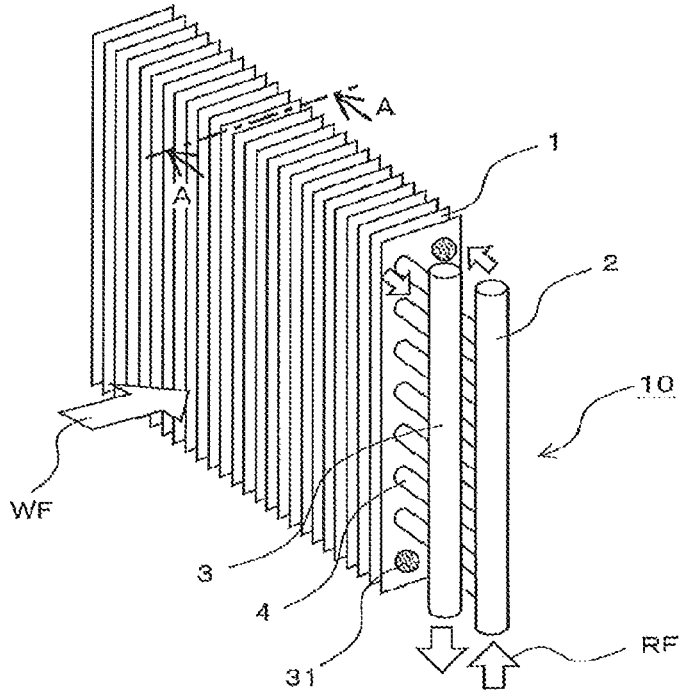
FIG. 7 is a perspective view showing a heat exchanger according to Embodiment 2 of the present invention.
Figure 8:
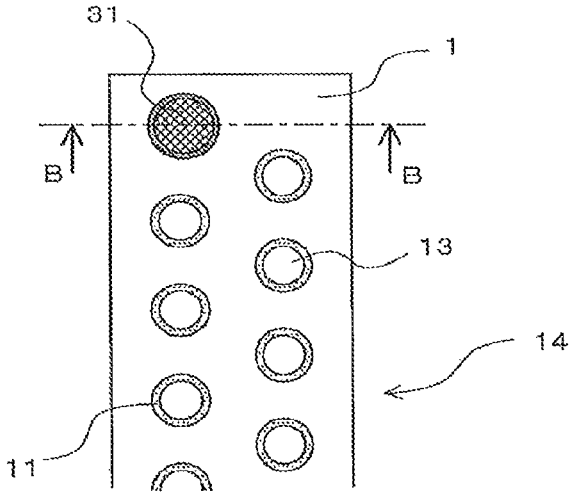
FIG. 8 is a cross-sectional view taken along a line A-A in FIG. 7, showing a fin core of the heat exchanger according to Embodiment 2 of the present invention.
Figure 9:
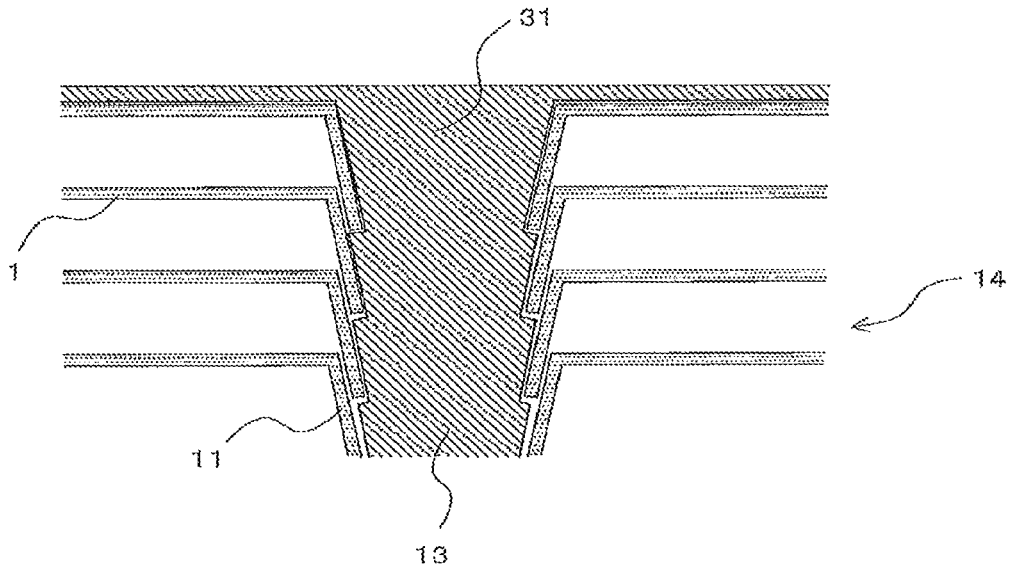
FIG. 9 is a cross-sectional view taken along a line B-B in FIG. 8, showing a conduit line of the heat exchanger according to Embodiment 2 of the present invention.

FIG. 7 is a perspective view showing a heat exchanger 10 according to Embodiment 2 of the present invention. FIG. 8 is a cross-sectional view taken along a line A-A in FIG. 7, showing a fin core 14 of the heat exchanger 10 according to Embodiment 2 of the present invention. FIG. 9 is a cross-sectional view taken along a line B-B in FIG. 8, showing a conduit line 13 of the heat exchanger 10 according to Embodiment 2 of the present invention.

As shown in FIG. 7 to FIG. 9, the heat exchanger 10 according to Embodiment 2 includes a resin-filled portion 31 that serves as the reinforcing member, provided in some of the plurality of conduit lines 13.

As shown in FIG. 8, the inside of some of the plurality of conduit lines 13, formed through the fins 1 serially connected in the stacking direction, is filled with a resin adhesive to form the resin-filled portion 31.

To form the resin-filled portion 31, processing for preventing leakage of the resin is performed on the terminal one of the stacked fins 1, through which the conduit lines 13 are formed, and which are serially connected by superposing the plurality of fin collars 11, formed on each of the fins 1 in a tapered cylindrical shape for example by pressing, and then the resin is injected into the conduit line 13 from the terminal one of the stacked fins 1 on the other side. The resin-filled portion 31 is formed by filling the entire inner space of the conduit line 13 from one end to the other, with the resin. The resin-filled portion 31 is not utilized for the heat exchange unlike the resin structure 15 of Embodiment 1, and therefore it is not necessary to connect the inlet header, the outlet header, and the connection pipes to the resin-filled portion 31.

In addition, the resin-filled portion 31 serves to reinforce some of the conduit lines 13 through which the refrigerant does not flow, and therefore the resin layer 12 formed in the remaining conduit lines 13, through which the refrigerant flows, is free from the risk of being peeled off owing to the presence of the resin-filled portion 31.

As described above, in the heat exchanger 10 according to Embodiment 2, some of the plurality of conduit lines 13 are filled with the resin and serve as the reinforcing member, and hence the rigidity of the heat exchanger 10 is increased. Therefore, the strength of the joint portion against a bending, twisting, or shearing force, applied when the heat exchanger 10 is installed in the casing or transported, can be improved. Further, since the resin is light in weight and inexpensive, both the weight and the cost of the heat exchanger 10 can be reduced, compared with the case of employing a reinforcing member made of a metal.

Embodiment 3

In Embodiment 3, the conduit line 13 includes fin fasteners 41 and 43, and a support rod 42, which serve as the reinforcing member. The items not specifically referred to in Embodiment 1 are the same as those of Embodiment 1.

Figure 10:
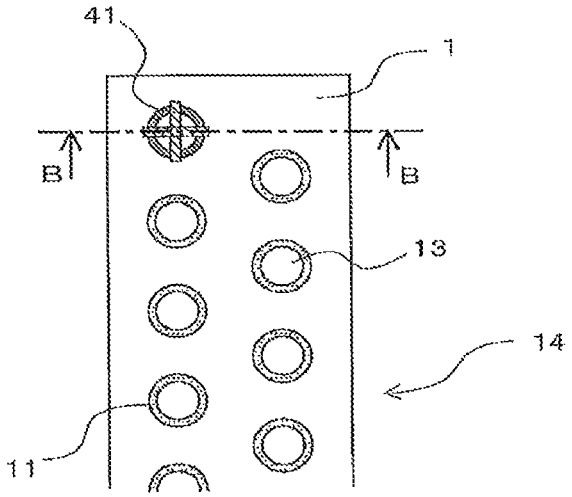
FIG. 10 is a view showing an end portion of a fin core of a heat exchanger according to Embodiment 3 of the present invention.
Figure 11:
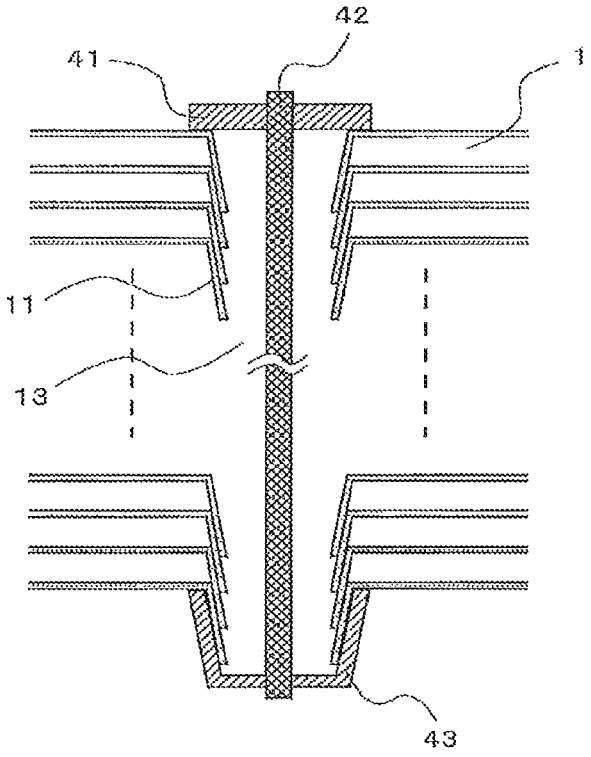
FIG. 11 is a cross-sectional view taken along a line B-B in FIG. 10, showing a conduit line of the heat exchanger according to Embodiment 3 of the present invention.

FIG. 10 is a view showing an end portion of a fin core 14 of a heat exchanger 10 according to Embodiment 3 of the present invention. FIG. 11 is a cross-sectional view taken along a line B-B in FIG. 10, showing a conduit line 13 of the heat exchanger 10 according to Embodiment 3 of the present invention.

As shown in FIG. 10 and FIG. 11, the support rod 42 is provided throughout the inside of some of the plurality of conduit lines 13 serially connected in the stacking direction. The fin fasteners 41 and 43 respectively provided on the end portions of the support rod 42 fasten the fin core 14, from the both end faces thereof. The fin fastener 41 has a cross shape, and is engaged with the opening of the fin collar 11 of the terminal one of the stacked fins 1. The fin fastener 43 covers the fin collar 11 sticking out from the terminal one of the stacked fins 1 on the other side. The support rod 42 is connected to the fin fasteners 41 and 43. Fixing the fin fasteners 41 and 43 to the respective end portions of the conduit line 13 improves the rigidity thereof against a force exerted in a direction to stretch the conduit line 13. In addition, the support rod 42 is retained with a spacing from the inner wall of the conduit line 13, when the fin fasteners 41 and 43 are fixed. Thus, the fin fasteners 41 and 43 and the support rod 42 reinforce the entirety of the conduit line 13, from one end to the other.

Here, either a resin or a metal may be employed to form the fin fasteners 41 and 43 and the support rod 42, provided that the rigidity required for fastening the fin core 14 can be attained. However, it is preferable to employ a resin, in the case where the fin fasteners 41 and 43 contact a portion of the fin 1 covered with the resin layer 12. The fin fasteners 41 and 43 may also be covered with the resin layer 12, like the conduit line 13. Further, at least one of the fin fasteners 41 and 43, and the support rod 42 may be formed of an elastic material to apply a biasing force in a direction to compress the conduit line 13.

As described above, the heat exchanger 10 according to Embodiment 3 includes the reinforcing member composed of the fin fasteners 41 and 43 and the support rod 42, and provided in some of the conduit lines 13. Therefore, the rigidity of the heat exchanger 10 is increased, and the strength of the joint portion against a bending, twisting, or shearing force, applied when the heat exchanger 10 is installed in the casing or transported, can be improved.

Further, since the support rod 42 is retained with a spacing from the inner wall of the conduit line 13, the support rod 42 is kept from contacting the resin layer 12 on the inner wall of the conduit line 13, and thus the resin layer 12 is prevented from being peeled off.

Embodiment 4

In Embodiment 4, the conduit line 13 includes a metal structure 61 that serves as the reinforcing member. The items not specifically referred to in Embodiment 4 are the same as those of Embodiment 1.

Figure 12:
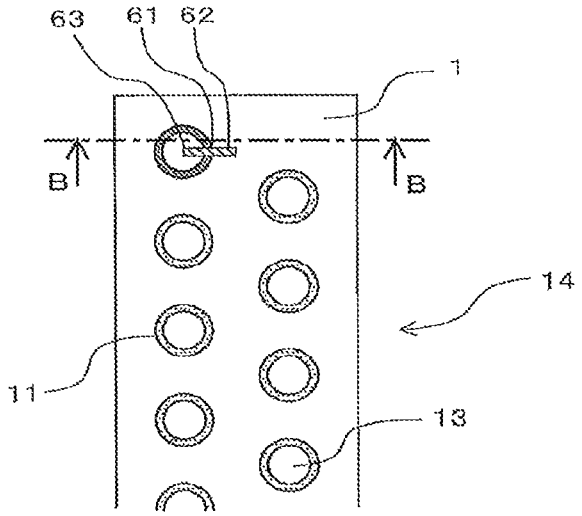
FIG. 12 is a cross-sectional view showing a fin core of a heat exchanger according to Embodiment 4 of the present invention.
Figure 13:
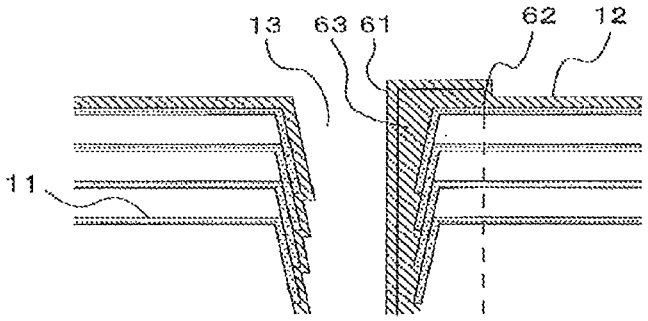
FIG. 13 is a cross-sectional view taken along a line B-B in FIG. 12, showing a conduit line of the heat exchanger according to Embodiment 4 of the present invention.

FIG. 12 is a cross-sectional view showing a fin core 14 of a heat exchanger 10 according to Embodiment 4 of the present invention. FIG. 13 is a cross-sectional view taken along a line B-B in FIG. 12, showing a conduit line 13 of the heat exchanger 10 according to Embodiment 4 of the present invention.

As shown in FIG. 12 and FIG. 13, some of the plurality of conduit lines 13 include the metal structure 61 of a plate shape, fitted to a slit 62 formed through the fins 1 and the fin collars 11. The plate-shaped metal structure 61 is fitted to the fins 1 and the fin collars 11, throughout the entirety of the conduit line 13, from one end to the other. The metal structure 61 is fitted to the slit 62 formed through the fins 1 and the fin collars 11, with an edge sticking out into the inner space of the conduit line 13.

The metal structure 61 fitted to the fins 1 and the fin collars 11 is covered with the resin, through the process of forming the resin layer 12 inside the conduit line 13.

Here, the metal structure 61 does not necessarily have to have a plate shape, provided that the edge 63 sticks out into the inner space of the conduit line 13, and may be fitted to the conduit line 13 at a plurality of positions.

In Embodiment 4, since the metal structure 61 has to be covered with the resin through the process of forming the resin layer 12, the metal structure 61 is fitted to the fins 1 and the fin collars 11, before the resin layer 12 is formed.

As described above, in the heat exchanger 10 according to Embodiment 4, some of the conduit lines 13 include the metal structure 61 serving as the reinforcing member, and therefore the rigidity of the heat exchanger 10 is increased. Accordingly, the strength of the joint portion against a bending, twisting, or shearing force, applied when the heat exchanger 10 is installed in the casing or transported, can be improved. In addition, the metal structure 61 contributes to increasing the heat transfer area between the refrigerant and air, to thereby improve the heat exchange efficiency.

Further, since the resin layer 12 is formed after the metal structure 61 is inserted and fixed, the resin layer 12 is continuously formed between the inner wall of the conduit line 13 and the surface of the metal structure 61. Therefore, the resin layer 12 is barely likely to be peeled off.

Embodiment 5

In Embodiment 5, the conduit line 13 includes a metal pipe 71 that serves as the reinforcing member. The items not specifically referred to in Embodiment 5 are the same as those of Embodiment 1.

Figure 14:
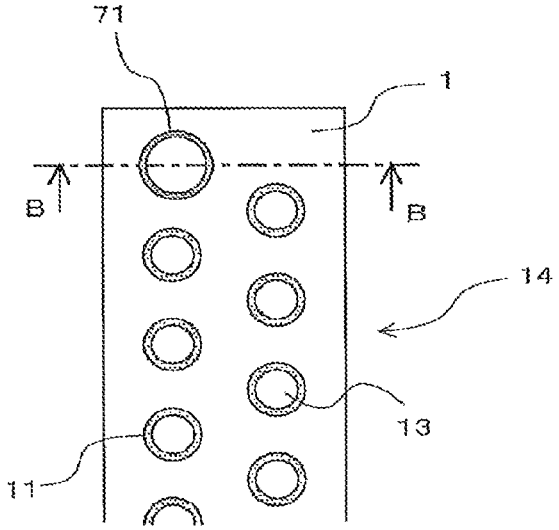
FIG. 14 is a cross-sectional view showing a fin core of a heat exchanger according to Embodiment 5 of the present invention.
Figure 15:
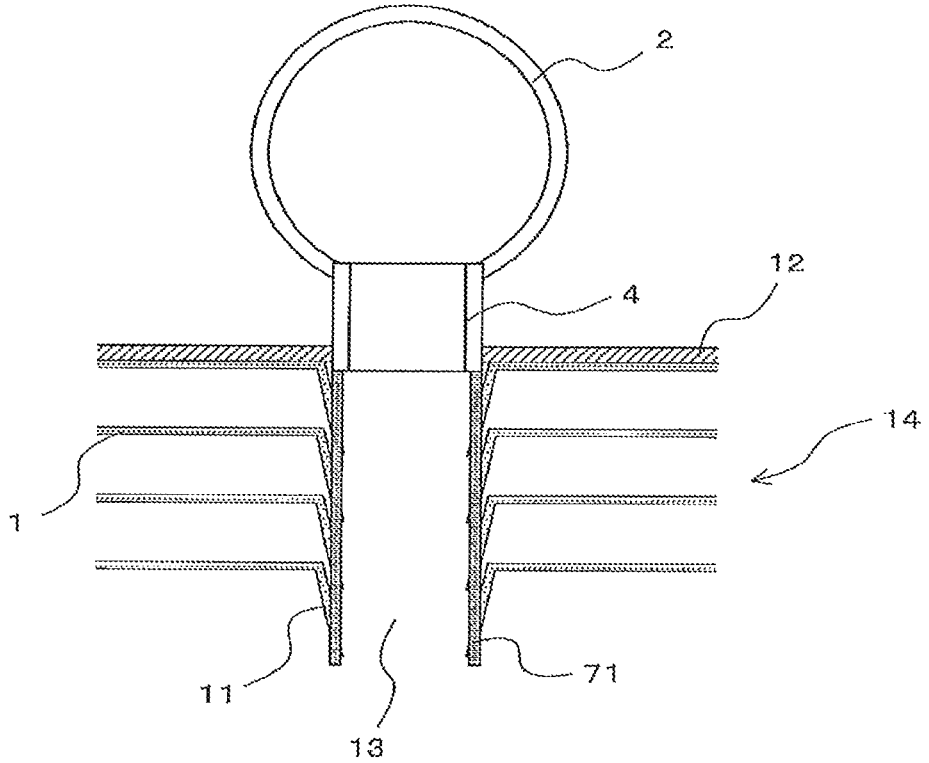
FIG. 15 is a cross-sectional view taken along a line B-B in FIG. 14, showing a conduit line of the heat exchanger according to Embodiment 5 of the present invention.

FIG. 14 is a cross-sectional view showing a fin core 14 of a heat exchanger 10 according to Embodiment 5 of the present invention. FIG. 15 is a cross-sectional view taken along a line B-B in FIG. 14, showing a conduit line 13 of the heat exchanger 10 according to Embodiment 5 of the present invention.

As shown in FIG. 14 and FIG. 15, the metal pipe 71 is inserted and fixed in some of the plurality of conduit lines 13. The metal pipe 71 is inserted in the conduit line 13 as shown in FIG. 14, and the diameter of the metal pipe 71 is enlarged by an expanding billet to swage the metal pipe 71 with the fin collars 11, thus to fix the metal pipe 71.

In the heat exchanger 10 according to Embodiment 5, some of the conduit lines 13 include the metal pipe 71 serving as the reinforcing member, and therefore the rigidity of the heat exchanger 10 is increased. Accordingly, the strength of the joint portion against a bending, twisting, or shearing force, applied when the heat exchanger 10 is installed in the casing or transported, can be improved. In addition, the machine for enlarging the diameter of the metal pipe 71 is popularly available in the manufacturing equipment of the heat exchanger 10, and therefore the existing equipment can be utilized as it is, to manufacture the aforementioned heat exchanger 10.

Since the plurality of conduit lines 13 continuously extend through the fins 1, reinforcing some of the conduit lines 13 by inserting the metal pipe 71 results in substantially reinforcing the remaining conduit lines 13 in each of which the metal pipe 71 is not provided. Reinforcing the plurality of conduit lines 13 prevents the resin layer 12 on the inner surface of the conduit lines 13 without the metal pipe 71, from being peeled off.

Embodiment 6

In Embodiment 6, the conduit line 13 includes the metal pipe 71 and a side plate 81 that serve as the reinforcing member. The items not specifically referred to in Embodiment 6 are the same as those of Embodiment 1 and Embodiment 5.

Figure 16:
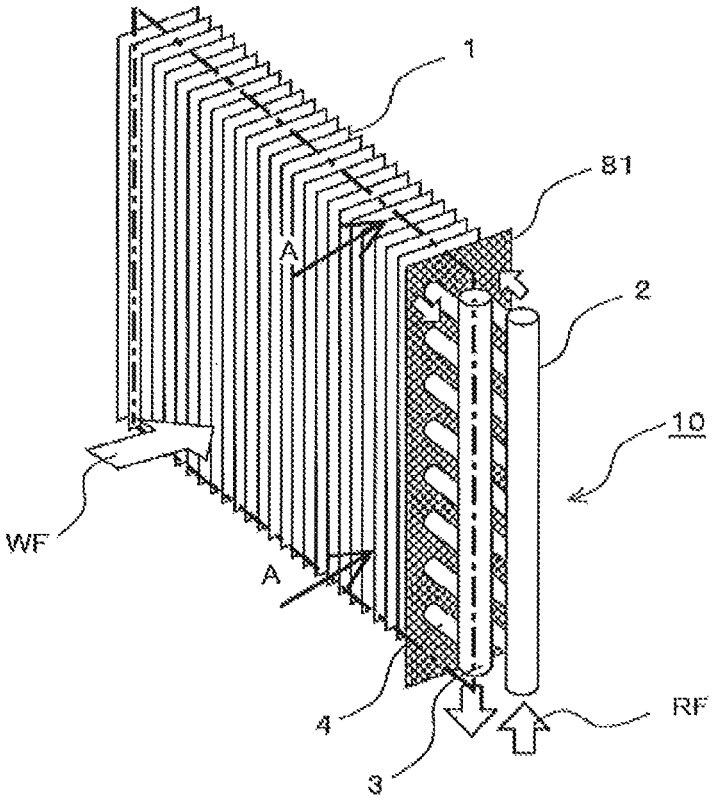
FIG. 16 is a perspective view showing a heat exchanger according to Embodiment 6 of the present invention.
Figure 17:
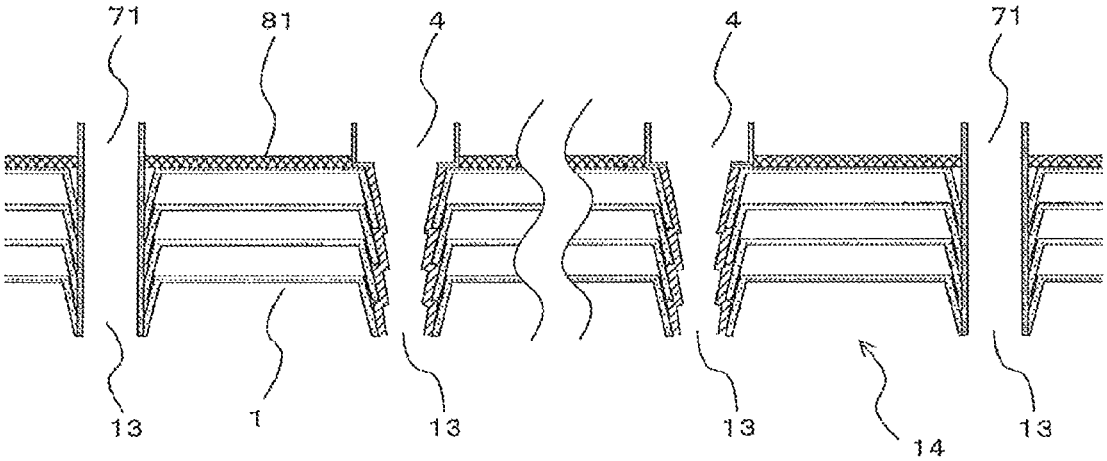
FIG. 17 is a cross-sectional view taken along a line A-A in FIG. 16, showing a conduit line of the heat exchanger according to Embodiment 6 of the present invention.

FIG. 16 is a perspective view showing a heat exchanger 10 according to Embodiment 6 of the present invention. FIG. 17 is a cross-sectional view taken along a line A-A in FIG. 16, showing a conduit line 13 of the heat exchanger 10 according to Embodiment 6 of the present invention.

As shown in FIG. 16 and FIG. 17, the metal pipe 71 is inserted and fixed in some of the plurality of conduit lines 13, together with the side plate 81. Referring to FIG. 17, the side plate 81 is fixed at the same time that the plurality of metal pipes 71 are fixed.

In the heat exchanger 10 according to Embodiment 6, the side plate 81 is attached, in addition to the metal pipe 71 provided in some of the conduit lines 13 as the reinforcing member. Therefore, the rigidity of the heat exchanger 10 is increased both in the stacking direction and in the horizontal direction. Consequently, the strength of the joint portion against a bending, twisting, or shearing force, applied when the heat exchanger 10 is installed in the casing or transported, can be significantly improved.

Embodiment 7

Embodiment 7 refers to the pipe diameter, the position, and the number of the conduit lines 13 that include the reinforcing member. The items not specifically referred to in Embodiment 7 are the same as those of Embodiments 1 to 6.

Figure 18:
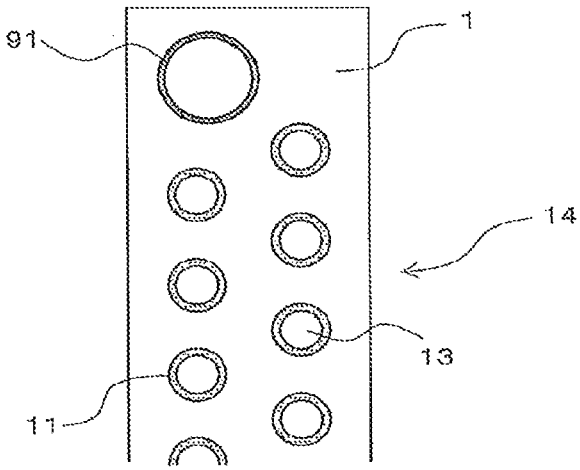
FIG. 18 is a cross-sectional view showing a fin core of a heat exchanger according to Embodiment 7 of the present invention.
Figure 19:
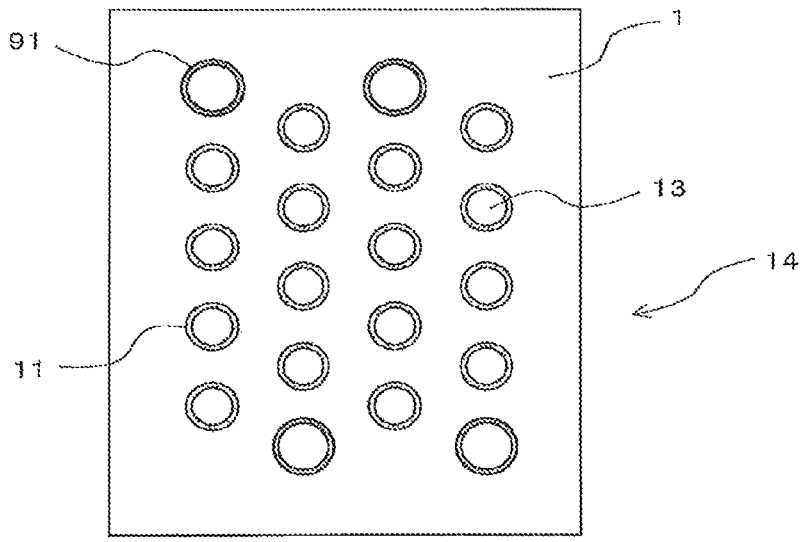
FIG. 19 is a cross-sectional view showing another fin core of the heat exchanger according to Embodiment 7 of the present invention.
Figure 20:
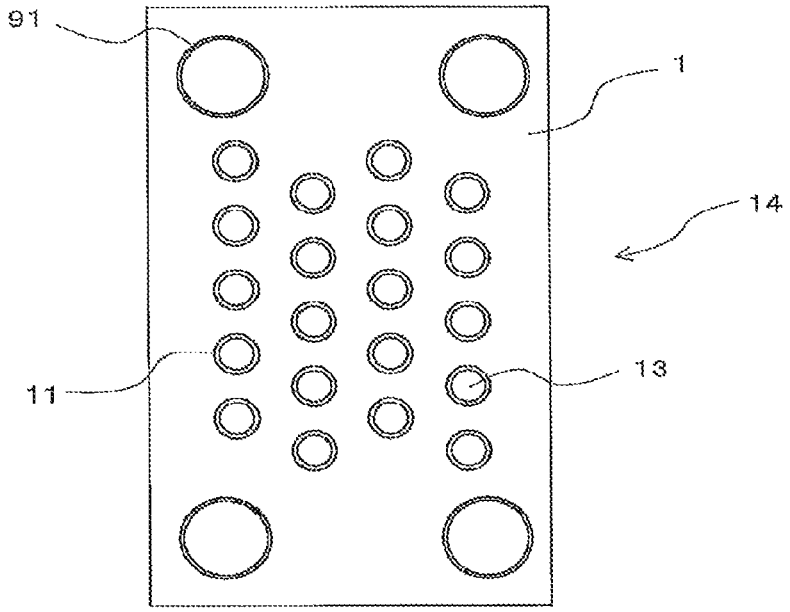
FIG. 20 is a cross-sectional view showing still another fin core of the heat exchanger according to Embodiment 7 of the present invention.

FIG. 18 is a cross-sectional view showing a fin core 14 of a heat exchanger 10 according to Embodiment 7 of the present invention. FIG. 19 is a cross-sectional view showing another fin core 14 of the heat exchanger 10 according to Embodiment 7 of the present invention. FIG. 20 is a cross-sectional view showing still another fin core 14 of the heat exchanger 10 according to Embodiment 7 of the present invention.

As shown in FIG. 18 to FIG. 20, the pipe diameter of a conduit line 91 that includes the reinforcing member may differ from the pipe diameter of the conduit lines 13 including the resin layer 12 and utilized for the heat exchange. From the viewpoint of improvement in performance and reduction in cost of the heat exchanger 10 in particular, it is preferable to make the conduit line 91 including the reinforcing member larger than the conduit lines 13 for the refrigerant, to both reduce the diameter of the conduit lines 13 and minimize the number of conduit lines 91 including the reinforcing member.

As shown in FIG. 18 to FIG. 20, the conduit line 91 including the reinforcing member is located at a position closest to the outer periphery of the fin 1. In particular, in the case where an even number of conduit lines 91 including the reinforcing member are provided, it is preferable to locate the conduit lines 91 to be symmetrical.

The conduit lines 13 in the fins 1 are arranged in a predetermined pattern. However, the conduit lines 91 including the reinforcing member do not have to follow the arrangement pattern of the conduit lines 13. It is preferable to locate the conduit lines 91 to maximize the rigidity of the heat exchanger 10, for example at the four corners of the fin 1 as shown in FIG. 20.

In the heat exchanger 10 according to Embodiment 7, the pipe diameter, the position, and the number of the conduit lines 91 that include the reinforcing member, are determined to maximize the rigidity of the heat exchanger 10, and therefore the strength of the joint portion against a bending, twisting, or shearing force, applied when the heat exchanger 10 is installed in the casing or transported, can be improved.

Embodiment 8

Embodiment 8 refers to the method of fastening the reinforcing member to the fin core 14. The items not specifically referred to in Embodiment 8 are the same as those of Embodiments 1 to 7, and the same functions and components are denoted by the same reference sign.

Figure 21:
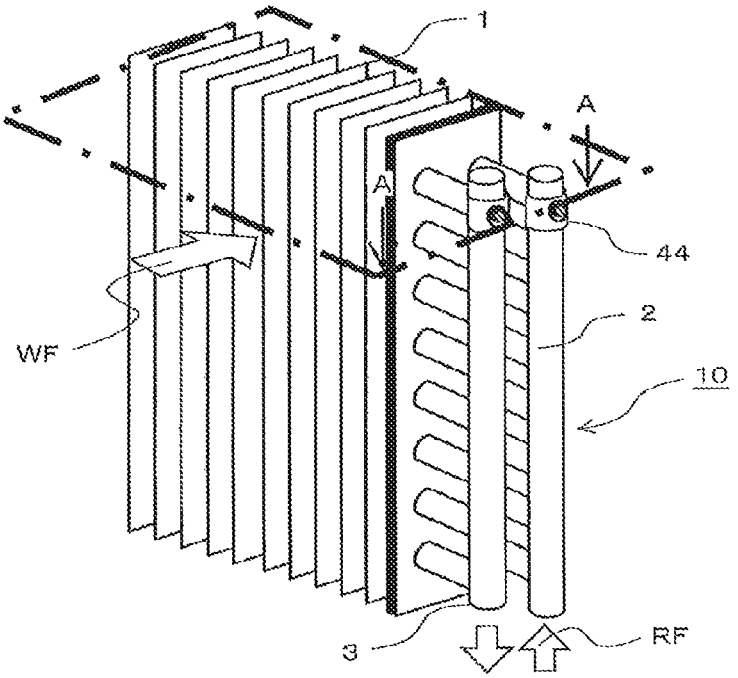
FIG. 21 is a perspective view showing a heat exchanger according to Embodiment 8 of the present invention.
Figure 22:
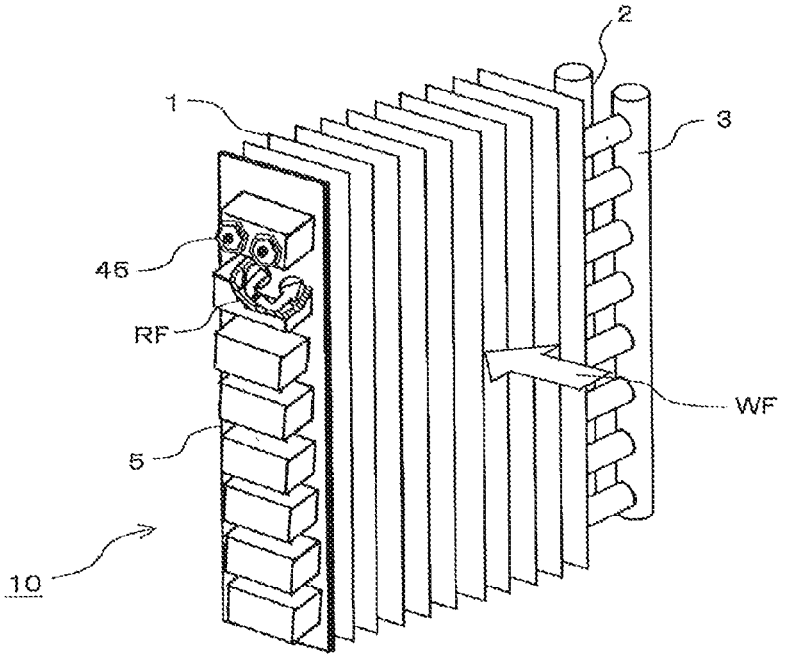
FIG. 22 is another perspective view showing the heat exchanger according to Embodiment 8 of the present invention.
Figure 23:
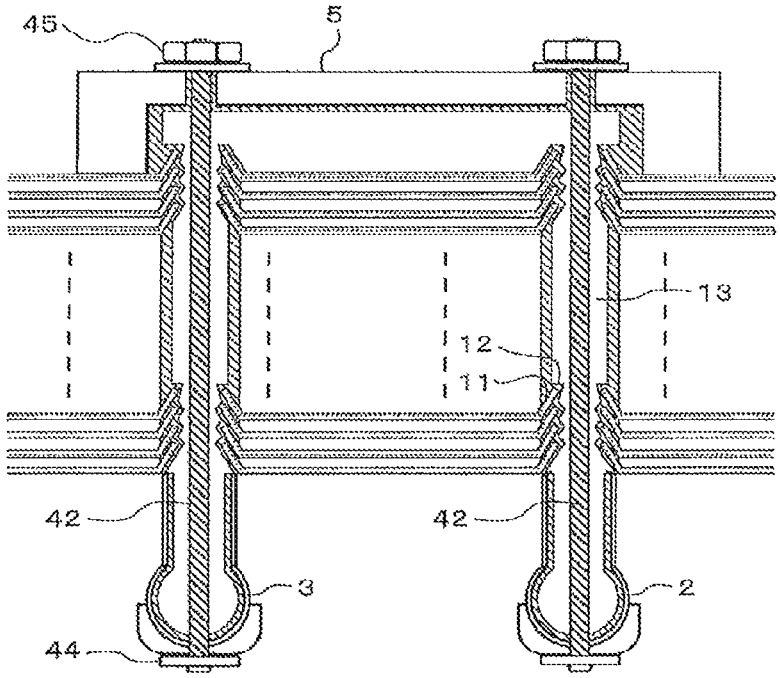
FIG. 23 is a cross-sectional view taken along a line A-A in FIG. 21, showing a conduit line of the heat exchanger according to Embodiment 8 of the present invention.

FIG. 21 is a perspective view showing a heat exchanger 10 according to Embodiment 8 of the present invention. FIG. 22 is another perspective view showing the heat exchanger 10 according to Embodiment 8 of the present invention. FIG. 23 is a cross-sectional view taken along a line A-A in FIG. 21, showing a conduit line 13 of the heat exchanger 10 according to Embodiment 8 of the present invention.

As shown in FIG. 21 to FIG. 23, the reinforcing member fastens the conduit line 13, with a header fastener 44 attached to each of the inlet header 2 and the outlet header 3 located at the end portions of the fin core 14, a communication member fastener 45 attached to at least one side of a communication member 5, such as a U-bend pipe, for turning the direction of the refrigerant that has passed through the conduit line 13 and conducting the refrigerant to another conduit line 13, and an elongate support rod 42 penetrating through the conduit line 13 from one end to the other and being connected to the header fastener 44 and the communication member fastener 45.

The communication member 5 may be formed in one integral piece to constitute a turning path, provided that the communication member 5 is connected to the end portion of the fin core 14 and communicates between two conduit lines 13. Alternatively, the communication member 5 may form the turning path by attaching a member having a concave surface to the fin core 14, and establishing communication between the outlets of two conduit lines 13.

The communication member 5 may be formed of either a metal or a resin, provided that the joint strength to the fin core 14 and corrosion resistance against moisture can be secured. The header fastener 44, the communication member fastener 45, and the support rod 42 may be formed of either a metal or a resin, provided that the rigidity required for fastening the fin core 14 is attained.

The joint portion between the communication member 5 and the fin core 14, and a gap in the reinforcing member passway of the communication member 5 may be covered with the communication member fastener 45. Further, the reinforcing member may be inserted and fixed before the surface of the fin collar 11 on the side of the liquid passage is covered with the resin, and then the joint portion between the communication member 5 and the fin core 14, and the gap in the reinforcing member passway of the communication member 5 may be filled with the resin.

In addition, the reinforcing member does not have to have the shape of the support rod shown in FIG. 23, but may be formed in any of the shapes of the reinforcing member according to Embodiments 1 to 7, provided that the reinforcing member is connected to the inlet header 2 or outlet header 3, and to the communication member 5. In particular, in the case of employing the reinforcing member according to Embodiment 2, the communication member 5 may be formed to communicate between at least two other conduit lines 13, through which the refrigerant flows.

In the heat exchanger 10 according to Embodiment 8, since the plurality of conduit lines 13 are constituted of the stacked fins 1, fastening the fins 1 in the stacking direction with the inlet header 2 or outlet header 3 and the communication member 5, which are provided at the end portions of the fins 1, results in substantially reinforcing the conduit lines 13. In addition, reinforcing the communication member 5 contributes to improving the joint strength against a stress imposed outwardly of the communication member 5, originating from the turning of the refrigerant flow in the liquid passage in the communication member 5. Further, the joint portions between the fin core 14 and the inlet header 2 or outlet header 3, and between the fin core 14 and the communication member 5, are also reinforced, and therefore the strength against a bending, twisting, or shearing force, applied when the heat exchanger 10 is installed in the casing or transported, can be improved.

Embodiment 9

Embodiment 9 refers to the shape of the reinforcing member according to Embodiment 8. The items not specifically referred to in Embodiment 9 are the same as those of Embodiment 8, and the same functions and components are denoted by the same reference sign.

Figure 24:
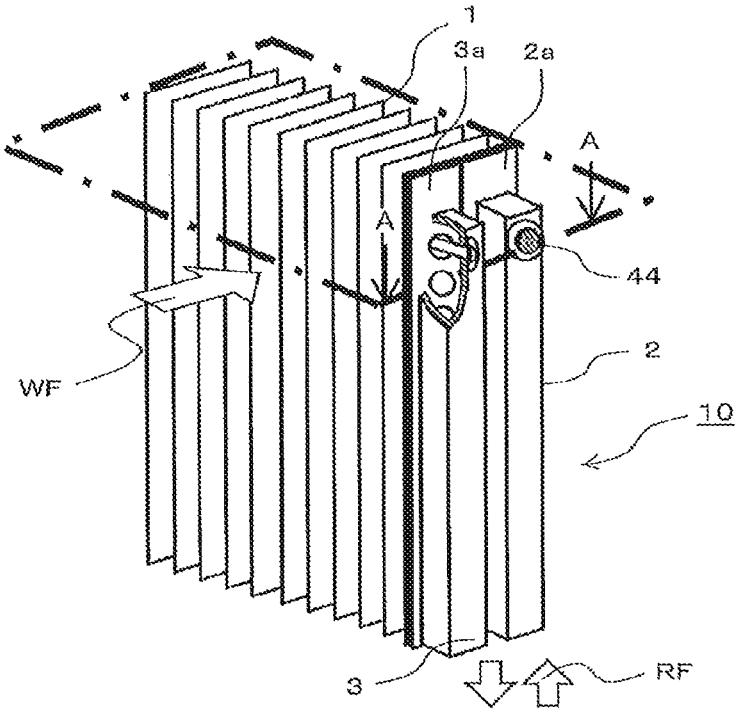
FIG. 24 is a perspective view showing a heat exchanger according to Embodiment 9 of the present invention.
Figure 25:
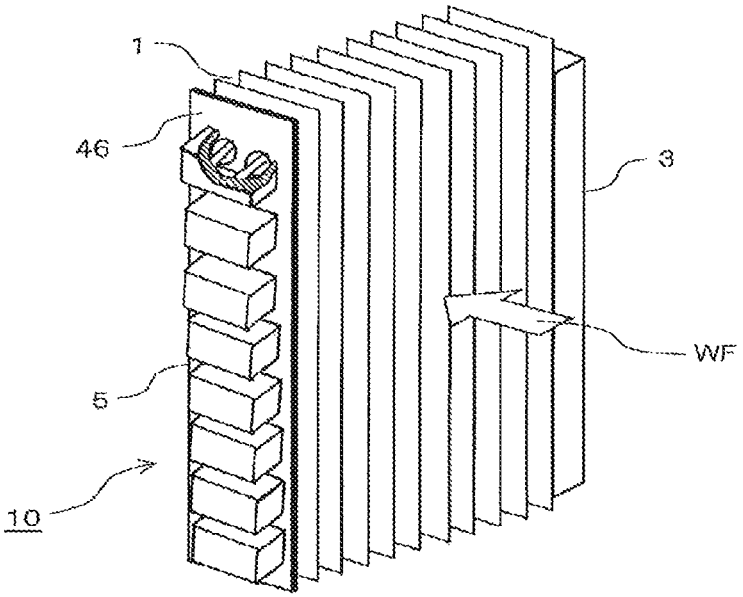
FIG. 25 is another perspective view showing the heat exchanger according to Embodiment 9 of the present invention.
Figure 26:
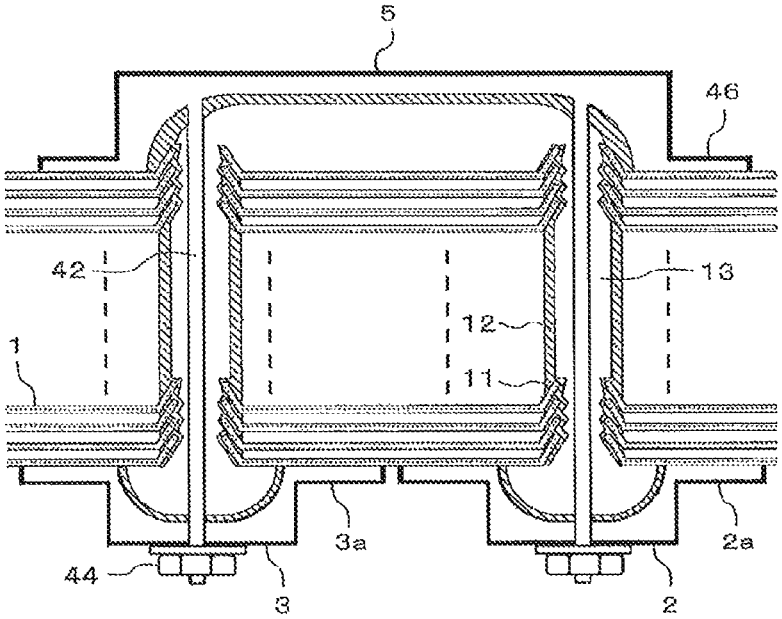
FIG. 26 is a cross-sectional view taken along a line A-A in FIG. 24, showing a conduit line of the heat exchanger according to Embodiment 9 of the present invention.

FIG. 24 is a perspective view showing a heat exchanger 10 according to Embodiment 9 of the present invention. FIG. 25 is another perspective view showing the heat exchanger 10 according to Embodiment 9 of the present invention. FIG. 26 is a cross-sectional view taken along a line A-A in FIG. 24, showing a conduit line 13 of the heat exchanger 10 according to Embodiment 9 of the present invention.

As shown in FIG. 24 to FIG. 26, the support rod 42 is integrally formed with the communication member 5 provided at one end portion of the fin core 14, and is connected to the inlet header 2 or outlet header 3 provided at the other end portion, through the liquid pipe, which is the conduit line 13.

The plurality of communication members 5 are integrally formed with a reinforcing wall 46, having the same shape as the fin 1 and provided at one end portion of the fin core 14.

A header fastener 44 is attached to each of the inlet header 2 and the outlet header 3. The inlet header 2 and the outlet header 3 are formed in a rectangular column shape for reinforcement purpose, are abutted against the other end portion of the fin core 14 via plate-shaped portions 2*a* and 3*a* respectively, and secure balance with the fastening force of the reinforcing wall 46 on the side of the plurality of communication members 5. The plate-shaped portions 2*a* and 3*a* extend along the surface of the fin 1, from the inlet header 2 and the outlet header 3 formed in the rectangular column shape. Thus, the heat exchanger 10 according to Embodiment 9 is without the joint pipes 4.

In the heat exchanger 10 according to Embodiment 9, the plurality of communication members 5 are integrally formed with the reinforcing wall 46. Accordingly, reinforcing some of the communication members 5 results in substantially reinforcing the other communication members 5 that do not have the support rod 42. Forming the plurality of communication members 5 integrally with the reinforcing wall 46 enables reduction of the number of joint positions of the communication members 5, to thereby minimize the risk of refrigerant leakage. In addition, the number of parts, such as the communication member fasteners, can also be reduced, and therefore both the weight and the manufacturing cost can be reduced.

Embodiment 10

Embodiment 10 refers to the shape of the communication member according to Embodiment 8. The items not specifically referred to in Embodiment 11 are the same as those of Embodiment 8, and the same functions and components are denoted by the same reference sign.

Figure 27:
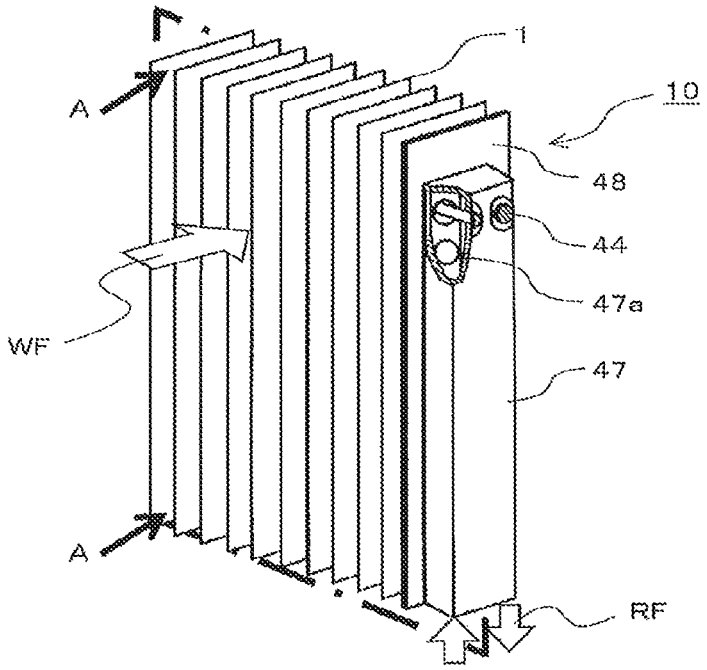
FIG. 27 is a perspective view showing a heat exchanger according to Embodiment 10 of the present invention.
Figure 28:
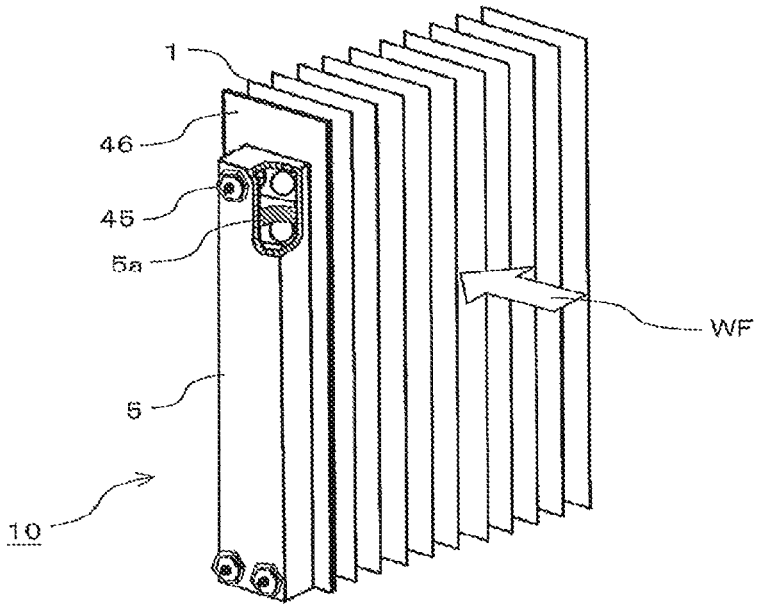
FIG. 28 is another perspective view showing the heat exchanger according to Embodiment 10 of the present invention.
Figure 29:
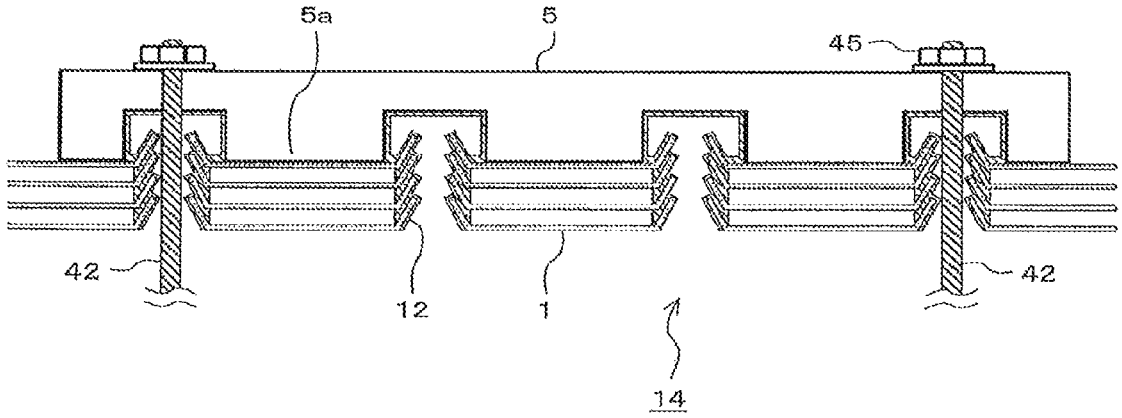
FIG. 29 is a cross-sectional view taken along a line A-A in FIG. 27, showing a conduit line of the heat exchanger according to Embodiment 10 of the present invention.

FIG. 27 is a perspective view showing a heat exchanger 10 according to Embodiment 10 of the present invention. FIG. 28 is another perspective view showing the heat exchanger 10 according to Embodiment 10 of the present invention. FIG. 29 is a cross-sectional view taken along a line A-A in FIG. 27, showing a conduit line 13 of the heat exchanger 10 according to Embodiment 10 of the present invention.

As shown in FIG. 27 to FIG. 29, the communication member 5 is formed in one integral piece and connects the plurality of conduit lines 13 in the fin core 14. Some of the conduit lines 13 in the fin core 14 are fastened with a reinforcing member passed through the conduit line 13. The inner space of the communication member 5 is divided by a partition 5*a* in a U-pipe shape, to conduct the refrigerant that has passed through the conduit line 13 to another conduit line 13. Thus, the communication member 5 includes a plurality of liquid paths, separated from each other by the partition 5*a* and formed in the U-pipe shape. The communication member 5 also constitutes a part of the reinforcing member.

In addition, the heat exchanger 10 includes a header unit 47 formed in one integral piece to serve as the reinforcing member, in place of the inlet header and the outlet header. The header unit 47 is fixed to a reinforcing wall 48 attached to the other end portion of the fin core 14 and secures balance with the fastening force of the reinforcing wall 46. The inner space of the header unit 47 is divided by a partition 47*a* to form two parallel paths in the vertical direction, and thus each of the paths serves as the inlet header or outlet header.

Further, the heat exchanger 10 includes the header fastener 44, the communication member fastener 45, and the support rod 42, which are also the components of the reinforcing member.

In the heat exchanger 10 according to Embodiment 10, the communication member 5 formed in one integral piece includes the plurality of liquid paths separated from each other, and is fixed to the fin core 14 with the support rod 42, provided in some of the liquid paths and inserted in the corresponding conduit line 13 in the fin core 14. The heat exchanger 10 also includes the header unit 47 formed in one integral piece to serve as the inlet header and the outlet header. Therefore, the strength required for fastening the fin core 14 with the communication member 5 and the header unit 47 can be secured, with a fewer number of reinforcing members than the number of liquid paths. Accordingly, the number of joint positions between the support rod 42 and the communication member 5 or the header unit 47 is reduced, which minimizes the risk of refrigerant leakage. Further, reducing the number of joint positions leads to reduction in manufacturing cost, and reducing the number of liquid pipes that include the reinforcing member contributes to improving the performance of the heat exchanger 10.

Here, employing a resin structural material having a low thermal conductivity than a metal to form the communication member 5 or the header unit 47 restricts the refrigerant from exchanging heat with the refrigerant flowing in another liquid path, to thereby reduce heat loss.

Embodiment 11

Figure 30:
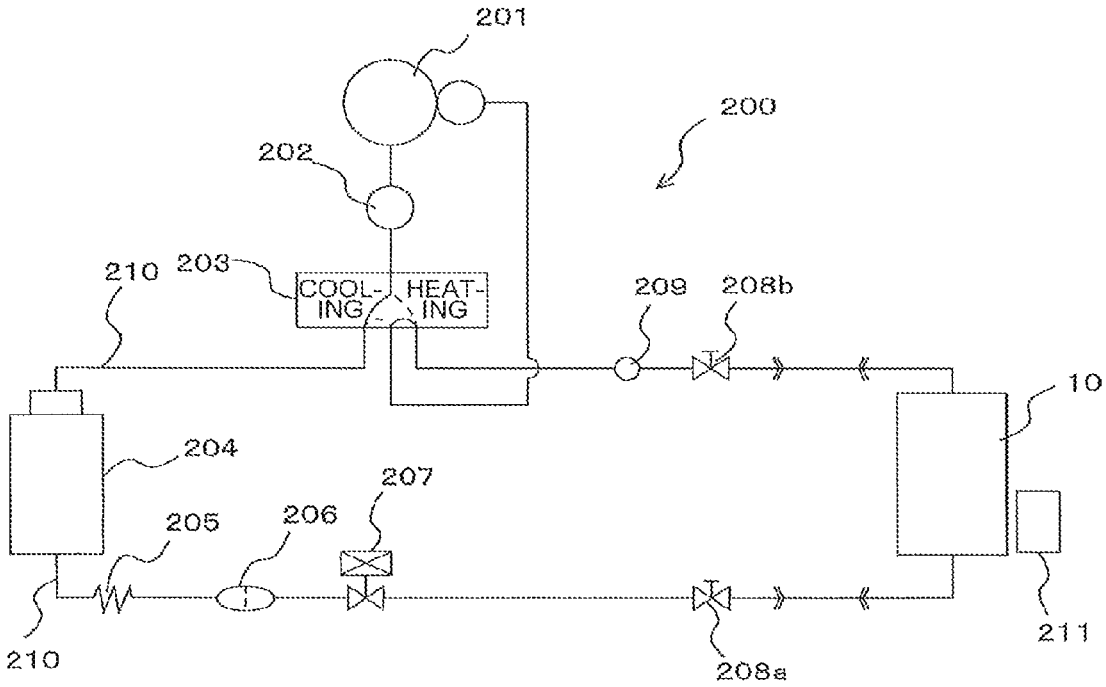
FIG. 30 is a refrigerant circuit diagram showing a general configuration of an air-conditioning apparatus according to Embodiment 11 of the present invention.

FIG. 30 is a refrigerant circuit diagram showing a general configuration of an air-conditioning apparatus 200 according to Embodiment 11 of the present invention.

As shown in FIG. 30, the air-conditioning apparatus 200 includes a refrigerant circuit composed of a compressor 201, a muffler 202, a four-way valve 203, an outdoor heat exchanger 204, capillary tubes 205, a strainer 206, an electronic expansion valve 207, stop valves 208*a* and 208*b*, the heat exchanger 10 serving as an indoor heat exchanger, and an auxiliary muffler 209, which are connected via a refrigerant pipe 210.

The indoor unit of the air-conditioning apparatus 200, including the heat exchanger 10, includes a controller 211 that controls the actuators such as the compressor 201 and the electronic expansion valve 207, on the basis of the temperature of outside air, room air, and the refrigerant. The four-way valve 203 serves to switch the refrigeration cycle between the cooling operation and the heating operation, under the control of the controller 211.

Referring now to FIG. 30, an example of the operation of the air-conditioning apparatus 200 performed for cooling will be described. When the controller 211 switches the four-way valve 203 to the cooling operation, the refrigerant compressed by the compressor 201 to turn into high-temperature and high-pressure gas refrigerant flows into the outdoor heat exchanger 204 through the four-way valve 203. The high-temperature and high-pressure gas refrigerant that has flowed into the outdoor heat exchanger 204 exchanges heat with (radiates heat to) the outside air flowing through the outdoor heat exchanger 204, and flows out in the form of high-pressure liquid refrigerant. The high-pressure liquid refrigerant that has flowed out from the outdoor heat exchanger 204 is depressurized in the capillary tubes 205 and the electronic expansion valve 207, thus to turn into low-pressure, two-phase gas-liquid refrigerant, and flows into the indoor heat exchanger, which is the heat exchanger 10. The two-phase gas-liquid refrigerant that has flowed into the heat exchanger 10 exchanges heat with the room air flowing through the heat exchanger 10, thus to cool the room air and turn into low-temperature and low-pressure gas refrigerant, and is sucked into the compressor 201.

Referring again to FIG. 30, an example of the operation of the air-conditioning apparatus 200 performed for heating will be described. When the controller 211 switches the four-way valve 203 to the heating operation, the refrigerant, compressed by the compressor 201 to turn into high-temperature and high-pressure gas refrigerant as above, flows into the indoor heat exchanger, which is the heat exchanger 10, through the four-way valve 203. The high-temperature and high-pressure gas refrigerant that has flowed into the heat exchanger 10 exchanges heat with the room air flowing through the heat exchanger 10, to heat the room air and turn into high-pressure liquid refrigerant. The high-pressure liquid refrigerant that has flowed out from the heat exchanger 10 is depressurized in the electronic expansion valve 207 and the capillary tubes 205, thus to turn into low-pressure, two-phase gas-liquid refrigerant, and flows into the outdoor heat exchanger 204. The low-pressure two-phase gas-liquid refrigerant that has flowed into the outdoor heat exchanger 204 exchanges heat with the outside air flowing through the outdoor heat exchanger 204, to turn into low-temperature and low-pressure gas refrigerant, and is sucked into the compressor 201.

The air-conditioning apparatus 200 according to Embodiment 11 includes the reinforcing member, for example the resin structure 15, provided in some of the conduit lines 13 of the heat exchanger 10. Accordingly, the rigidity of the heat exchanger 10 is increased, and the strength of the joint portion between the serially connected fin collars 11, against a bending, twisting, or shearing force applied when the heat exchanger 10 is installed in the casing or transported, can be improved. In addition, there is no need to increase the thickness of the resin layer 12 in the conduit line 13 to increase the strength of the joint portion, and the resin layer 12 can be formed in a thin thickness on the surface of the inner wall of the conduit line 13 formed of the fin collars 11, which prevents degradation in heat exchange performance originating from an increase in thermal resistance of the resin layer 12. Consequently, a high performance level, and reliability in strength and corrosion resistance, can both be secured.

Advantageous Effects

The heat exchanger 10 according to Embodiments 1 to 11 includes the plurality of fins 1 each including the fin collars 11 formed in a short cylindrical shape by perforating the flat base plate. The plurality of fins 1 are stacked on each other by serially connecting the fin collars 11 of the respective fins 1, and the serially connected fin collars 11 are bonded to each other to form the conduit lines 13 and the fin core 14. The conduit lines 13 each include the resin layer 12 formed on the inner surface thereof. The heat exchanger 10 also includes the reinforcing member having the length corresponding to the length of the conduit line 13 from one end to the other end thereof, to improve rigidity of the conduit line 13.

The heat exchanger 10 configured as above includes the reinforcing member, having the length corresponding to the length of the conduit line 13 from one end to the other, to improve the rigidity of the conduit line 13, and therefore the rigidity of the heat exchanger 10 is increased. Accordingly, the strength of the joint portion against a bending, twisting, or shearing force, applied when the heat exchanger 10 is installed in the casing or transported, can be improved. In addition, there is no need to increase the thickness of the resin layer 12 to increase the strength of the joint portion, and the resin layer 12 can be formed in a thin thickness on the surface of the inner wall of the conduit line 13 formed of the fin collars 11, which prevents degradation in heat exchange performance originating from an increase in thermal resistance of the resin layer 12. Consequently, a high performance level, and reliability in strength and corrosion resistance, can both be secured.

The reinforcing member is provided only in some of conduit lines 13, out of the plurality of conduit lines 13.

With the mentioned configuration, the rigidity of the heat exchanger 10 can be increased, by providing the reinforcing member in some of conduit lines 13 through which the refrigerant flows.

At least a part of the reinforcing member is covered with the same resin layer 12 covering the inner surface of the conduit line 13.

In this case, since at least a part of the surface of the reinforcing member is covered with the resin layer 12, the resin layer 12 can be prevented from being peeled off.

The reinforcing member is constituted of the resin structure 15 located inside the conduit line 13.

In this case, since some of the conduit lines 13 include the reinforcing member made of a resin, the rigidity of the heat exchanger 10 is increased. Accordingly, the strength of the joint portion against a bending, twisting, or shearing force, applied when the heat exchanger 10 is installed in the casing or transported, can be improved. Further, since the resin is light in weight and inexpensive, both the weight and the cost of the heat exchanger 10 can be reduced.

The reinforcing member is constituted of the resin-filled portion 31 formed by filling the inner space of at least one of the plurality of conduit lines 13 with a resin.

With the mentioned configuration, some of the conduit lines 13 filled with the resin serve as the reinforcing member, and hence the rigidity of the heat exchanger 10 is increased. Accordingly, the strength of the joint portion against a bending, twisting, or shearing force, applied when the heat exchanger 10 is installed in the casing or transported, can be improved. Further, since the resin is light in weight and inexpensive, both the weight and the cost of the heat exchanger 10 can be reduced.

In addition, the resin-filled portion 31 only reinforces some of the conduit lines 13 through which the refrigerant does not flow, and therefore the resin layer 12 of the remaining conduit lines 13 through which the refrigerant flows is free from the risk of being peeled off owing to the presence of the resin-filled portion 31.

The reinforcing member is configured to fasten the both end faces of the fin core 14 with the support rod 42 passed through the conduit line 13.

In this case, the support rod 42 is passed through the inside of some of the conduit lines 13, and fastens the fin core 14 from both sides to thereby reinforce the fin core 14. Accordingly, the rigidity of the heat exchanger 10 is increased. Therefore, the strength of the joint portion against a bending, twisting, or shearing force, applied when the heat exchanger 10 is installed in the casing or transported, can be improved.

Further, since the support rod 42 is retained with a spacing from the inner wall of the conduit line 13, the support rod 42 is kept from contacting the resin layer 12 on the inner wall of the conduit line 13, and thus the resin layer 12 is prevented from being peeled off.

The reinforcing member is constituted of the metal structure 61, fitted in the slit 62 formed in the fin collar 11 and having the edge sticking out into the inner space of the conduit line 13.

With the mentioned configuration, since some of the conduit lines 13 include the metal structure 61 serving as the reinforcing member, the rigidity of the heat exchanger 10 is increased. Accordingly, the strength of the joint portion against a bending, twisting, or shearing force, applied when the heat exchanger 10 is installed in the casing or transported, can be improved. In addition, the metal structure 61 contributes to increasing the heat transfer area between the refrigerant flowing in the conduit line 13 and air, thus to improve the thermal conduction between the refrigerant and air. Therefore, the heat exchange efficiency can be improved.

Further, the resin layer 12 is formed after the metal structure 61 is inserted and fixed, and hence the resin layer 12 is continuously formed between the inner wall of the conduit line 13 and the surface of the metal structure 61. Therefore, the resin layer 12 is barely likely to be peeled off.

The reinforcing member is constituted of the metal pipe 71 inserted and fixed in the conduit line 13.

With the mentioned configuration, since some of the conduit lines 13 include the metal pipe 71 serving as the reinforcing member, the rigidity of the heat exchanger 10 is increased. Accordingly, the strength of the joint portion against a bending, twisting, or shearing force, applied when the heat exchanger 10 is installed in the casing or transported, can be improved.

In addition, the machine for enlarging the diameter of the metal pipe 71 is popularly available in the manufacturing equipment of the heat exchanger 10, and therefore the existing equipment can be utilized as it is, to manufacture the heat exchanger 10.

Since the plurality of conduit lines 13 continuously extend through the fins 1, reinforcing some of the conduit lines 13 by inserting the metal pipe 71 results in substantially reinforcing the remaining conduit lines 13 in which the metal pipe 71 is not provided. Reinforcing the plurality of conduit lines 13 prevents the resin layer 12 on the inner surface of the conduit lines 13 without the metal pipe 71, from being peeled off.

The reinforcing member includes the side plate 81 attached to the terminal one of the plurality of fins 1, to insert and fix the metal pipes 71. Attaching the side plate 81 for reinforcement, in addition to providing the metal pipe 71 in some of the conduit lines 13 as the reinforcing member, contributes to increasing the rigidity of the heat exchanger 10, both in the stacking direction and in the horizontal direction. Consequently, the strength of the joint portion against a bending, twisting, or shearing force, applied when the heat exchanger 10 is installed in the casing or transported, can be significantly improved.

The conduit line 91 including the reinforcing member, out of the plurality of conduit line 13, is different in diameter from the other conduit lines 13. Maximizing the rigidity of the heat exchanger 10, by properly setting the diameter of a conduit line 91 including the reinforcing member, leads to improved strength of the joint portion against a bending, twisting, or shearing force, applied when the heat exchanger 10 is installed in the casing or transported.

The conduit line 91 including the reinforcing member is located at a position closest to the outer periphery of the fin 1. Maximizing the rigidity of the heat exchanger 10, by properly setting the diameter, the position, and the number of the conduit lines 91 that include the reinforcing member, leads to improved strength of the joint portion against a bending, twisting, or shearing force, applied when the heat exchanger 10 is installed in the casing or transported.

The reinforcing member is attached to penetrate through the inlet header 2 or outlet header 3, connected to one end portion of the conduit lines 13 in the fin core 14, and the communication member 5 for conducting the refrigerant from one conduit line 13 to another.

The mentioned configuration improves the joint strength between the fin core 14 and the communication member 5, to thereby improve the strength against a stress imposed outwardly of the communication member 5, originating from the turning of the refrigerant flow. Further, the joint portions between the fin core 14 and the inlet header 2 or outlet header 3, and between the fin core 14 and the communication member 5, are also reinforced. Accordingly, the strength against a bending, twisting, or shearing force, applied when the heat exchanger 10 is installed in the casing or transported, can be improved.

The reinforcing member is integrally formed with the header unit 47, or with the communication member 5.

The mentioned configuration enables reduction of the number of joint positions between the reinforcing member and the header unit 47 or the communication member 5, to thereby minimize the risk of refrigerant leakage. In addition, the number of parts, such as the communication member fasteners, can also be reduced, and therefore both the weight and the manufacturing cost can be reduced.

The communication member 5 is formed in one integral piece to enclose a plurality of liquid passages and connect the conduit lines 13, and includes the reinforcing member provided in some of the conduit lines 13 through which the refrigerant flows.

Fixing thus the reinforcing member, including the integrally formed communication member 5 provided in some of the conduit lines 13, to the fin core 14 allows the strength required for fastening the fin core 14 with the communication member 5 to be secured, with a fewer number of reinforcing members than the number of liquid paths. Accordingly, the number of joint positions between the reinforcing member and the communication member 5 is reduced, which minimizes the risk of refrigerant leakage. Further, reducing the number of joint positions leads to reduction in manufacturing cost, and reducing the number of liquid pipes that include the reinforcing member contributes to improving the performance of the heat exchanger 10. In addition, employing a resin structural material having a low thermal conductivity than a metal to form the communication member 5 restricts the refrigerant from exchanging heat with the refrigerant flowing in another liquid path, to thereby reduce heat loss.

In the case of employing a refrigerant that contains water, it is preferable to prevent corrosion of the metal constituting the fin core 14. In the heat exchanger 10, the inner wall of the conduit line 13 is covered with the resin layer 12 formed of a thin film, to prevent corrosion of the fin collars 11. In the case of employing, in particular, aluminum or an alloy containing aluminum to form the fin core 14, it is preferable to prevent formation of a pinhole or crack in the resin layer 12. In the heat exchanger 10, the conduit line 13 is reinforced with the reinforcing member, to prevent the serially connected fin collars 11 from being mechanically deformed, which contributes to preventing formation of a crack in the resin layer 12. In the heat exchanger 10, further, a resin material may be employed to form the reinforcing member to be inserted in the conduit line 13. In addition, the reinforcing member may be fixed outside of the conduit line 13, away from the inner wall of the conduit line 13. Reinforcing only some of conduit lines 13 with the reinforcing member results in substantially reinforcing the remaining conduit lines 13 not including the reinforcing member. The reinforcing member formed to contact the inner wall of the conduit line 13 can be covered with the resin layer 12, together with the inner wall. The mentioned reinforcing members contribute to preventing the resin layer 12 from, for example, being peeled off. Therefore, the metal constituting the fin core 14 can be prevented from being corroded, and consequently the service life of the heat exchanger 10 can be extended.

The air-conditioning apparatus 200 includes the compressor 201, the outdoor heat exchanger 204, the electronic expansion valve 207, and the indoor heat exchanger, which is the heat exchanger 10.

The air-conditioning apparatus 200 configured as above includes the reinforcing member, for example the resin structure 15, provided in some of the conduit lines 13 of the heat exchanger 10, and therefore the rigidity of the heat exchanger 10 is increased. Accordingly, the strength of the joint portion between the serially connected fin collars 11, against a bending, twisting, or shearing force applied when the heat exchanger 10 is installed in the casing or transported, can be improved. In addition, there is no need to increase the thickness of the resin layer 12 in the conduit line 13 to increase the strength of the joint portion, and the resin layer 12 can be formed in a thin thickness on the surface of the inner wall of the conduit line 13 formed of the fin collars 11, which prevents degradation in heat exchange performance originating from an increase in thermal resistance of the resin layer 12. Consequently, a high performance level, and reliability in strength and corrosion resistance, can both be secured.

It is a matter of course that the configurations of Embodiments may be combined as desired. It should be understood that Embodiments disclosed above are merely exemplary in all aspects, and in no way intended to limit the present invention. The scope of the present invention is defined by the appended claims, not by the foregoing descriptions, and encompasses all modifications made within the scope of the claims and the equivalents thereof.

REFERENCE SIGNS LIST

1: fin, 2: inlet header, 2*a*: plate-shaped portion, 3: outlet header, 3*a*: plate-shaped portion, 4: connection pipe, 5: communication member, 5*a*: partition, 10: heat exchanger, 11: fin collar, 12: resin layer, 13: conduit line, 14: fin core, 15: resin structure, 21: cylindrical portion, 22: top portion, 31: resin-filled portion, 41: fin fastener, 42: support rod, 43: fin fastener, 44: header fastener, 45: communication member fastener, 46: reinforcing wall, 47: header unit, 47*a*: partition, 48: reinforcing wall, 61: metal structure, 62: slit, 63: end portion, 71: metal pipe, 81: side plate, 91: conduit line, 200: air-conditioning apparatus, 201: compressor, 202: muffler, 203: four-way valve, 204: outdoor heat exchanger, 205: capillary tube, 206: strainer, 207: electronic expansion valve, 208*a*: stop valve, 208*b*: stop valve, 209: auxiliary muffler, 210: refrigerant pipe, 211: controller

The invention claimed is:

1. A heat exchanger including a plurality of fins each including a fin collar formed in a short cylindrical shape by perforating a flat base plate, the plurality of fins being stacked by serially connecting fin collars of the respective fins, the serially connected fin collars being bonded to form a plurality of conduit lines and a fin core, the conduit lines each including a resin layer formed on an inner surface thereof, the heat exchanger comprising:

a reinforcer provided to at least one, but not all, of the conduit lines, and having a length corresponding to a length of the conduit lines from one end to another end thereof, wherein liquid is configured to flow through at least one of the conduit lines to which the reinforcer is provided.

2. The heat exchanger of claim 1, wherein at least a part of the reinforcer is covered with the same resin layer covering the inner surface of the conduit line.

3. The heat exchanger of claim 1, wherein the reinforcer includes a resin structural material located inside the at least one, but not all, of the conduit lines.

4. The heat exchanger of claim 1, wherein the reinforcer includes a resin-filled portion filled with resin, the resin-filled portion being formed by filling an inner space of the at least one, but not all, of the conduit lines.

5. The heat exchanger of claim 1, wherein the reinforcer is configured to fasten both end faces of the fin core with a support rod passed through the at least one, but not all, of the conduit lines.

6. The heat exchanger of claim 1, wherein the reinforcer includes a metal structure fitted to a slit formed in the fin collar and having an edge sticking out into an inner space of the at least one, but not all, of the conduit lines.

7. The heat exchanger of claim 1, wherein the reinforcer includes a metal pipe inserted and fixed in the at least one, but not all, of the conduit lines.

8. The heat exchanger of claim 7, wherein the reinforcer includes a side plate attached to an end face of the plurality of fins, to insert and fix the metal pipe.

9. The heat exchanger of claim 1, wherein the at least one, but not all, of the conduit lines including the reinforcer, is different in diameter from other conduit lines.

10. The heat exchanger of claim 1, wherein the some of the conduit lines including the reinforcer is located at a position closest to an outer periphery of a fin of the plurality of fins.

11. The heat exchanger of claim 1, wherein the reinforcer is attached to penetrate through a header connected to an end portion of the conduit line in the fin core, or a communication member for conducting liquid from one end to another end of the conduit lines.

12. The heat exchanger of claim 11, wherein the reinforcer is integrally formed with the header, or with the communication member.

13. The heat exchanger of claim 11, wherein the communication member is formed in one integral piece to enclose a plurality of liquid passages and connect conduit lines, and the reinforcer is provided in at the least one, but not all, of conduit lines through which the liquid flows.

14. An air-conditioning apparatus comprising:

a compressor;

an outdoor heat exchanger;

an electronic expansion valve; and an indoor heat exchanger, wherein the indoor heat exchanger includes a plurality of fins each including a fin collar formed in a short cylindrical shape by perforating a flat base plate, the plurality of fins being stacked by serially connecting fin collars of the respective fins, the serially connected fin collars being bonded to form a plurality of conduit lines and a fin core, the conduit lines each including a resin layer formed on an inner surface thereof, the indoor heat exchanger including a reinforcer member provided to at least one, but not all, of the conduit lines, and having a length corresponding to a length of the conduit lines from one end to another end thereof, wherein liquid is configured to flow through at least one of the conduit lines to which the reinforcer is provided.

15. The heat exchanger of claim 1, wherein the fin collar of at least one of the plurality of fins crosses a largest central plane of an adjacent one of the plurality of fins.

16. The heat exchanger of claim 1, wherein the fin collar of one of the plurality of fins that is formed in a short cylindrical shape extends into a fin collar of an adjacent one of the plurality of fins.

17. The heat exchanger of claim 1, wherein the liquid is configured to flow in direct contact with the resin layer formed on the inner surface of the conduit lines.

* * * * *